US006158673A

United States Patent [19]

Toetschinger et al.

[11] Patent Number: 6,158,673

[45] **Date of Patent: *Dec. 12, 2000**

[54] PORTABLE UNIT WALL UNIT DISPENSERS AND METHOD OF DISPENSING

[75] Inventors: Mark J. Toetschinger, Mendota Heights; Mary M. Dawson, Lakeville; Daniel E. Pedersen, Cottage Grove, all of Minn.

[73] Assignee: Ecolab Inc., St. Paul, Minn.

[ * ] Notice: This patent is subject to a terminal disclaimer.

[21] Appl. No.: 09/347,694

[22] Filed: Jul. 2, 1999

Related U.S. Application Data

[63] Continuation-in-part of application No. 09/033,229, Mar. 2, 1998, Pat. No. 5,996,907.

[51] Int. Cl.[7] ..... B05B 12/14

[52] U.S. Cl. ..... 239/305; 239/318; 239/443

[58] Field of Search ..... 239/304, 305, 239/312, 318, 335, 443, 722

[56] References Cited

U.S. PATENT DOCUMENTS

| | | | |
|---|---|---|---|
| 3,454,042 | 7/1969 | Phillips | 137/565 |
| 3,589,614 | 6/1971 | Kinville | 239/142 |
| 3,680,786 | 8/1972 | Levy | 239/146 |
| 3,894,690 | 7/1975 | Hill | 239/126 |
| 3,900,165 | 8/1975 | Parke et al. | 239/375 |
| 3,909,197 | 9/1975 | Cremers | 8/158 |
| 3,964,689 | 6/1976 | Horvath, Jr. | 239/318 |
| 4,182,491 | 1/1980 | Parke et al. | 239/11 |
| 4,208,013 | 6/1980 | Coleman et al. | 239/351 |
| 4,790,454 | 12/1988 | Clark et al. | 222/136 |
| 4,865,255 | 9/1989 | Luvisotto | 239/149 |
| 4,967,960 | 11/1990 | Futrell | 239/148 |
| 5,029,758 | 7/1991 | Chayer | 239/172 |
| 5,100,059 | 3/1992 | Englhard et al. | 239/310 |
| 5,259,557 | 11/1993 | Spriggs et al. | 239/304 |
| 5,263,223 | 11/1993 | Fiegel et al. | 15/321 |
| 5,343,591 | 9/1994 | Clark | 15/322 |
| 5,385,044 | 1/1995 | Thomas et al. | 73/295 |
| 5,421,900 | 6/1995 | Clontz | 134/14 |
| 5,651,398 | 7/1997 | Decker et al. | 141/18 |
| 5,707,590 | 1/1998 | Thomas et al. | 422/119 |

OTHER PUBLICATIONS

WIPEOUT™, Model WS1000—Cordless Spot Deep Cleaner/Smooth Surface Washer product literautre, Singer.

SPOT COP™, Model WS750—Hand–Held Spot Deep Cleaner & Wte Vac product literature, Singer.

SOIL SPORT™, Model WS1500—Versatile, Powerful, Multi–Surface Cleaning Machine product literuate, Singer.

Kärcher, Window Washer 250 product ltterature, Kärcher, Alfred Inc.

*Primary Examiner*—Lesley D. Morris

*Attorney, Agent, or Firm*—Mau & Krull, P.A.

[57] ABSTRACT

The invention includes a first dispenser for providing a first dilute concentrate of a use solution in a bottle. This bottle is then used in a portable delivery/dilution device which provides for a second level of concentration of the use solution. The bottles in which the solution is placed has both a vertical and horizontal lockout. The horizontal lockout is useful in making certain the right bottles are utilized with each dispenser and the vertical lockouts are useful in guiding the bottle upwards as the first concentration of liquid is placed in the bottle. The portable delivery/dilution system is easily portable, easily filled with water which can be easily poured from a system after use. The battery is rechargeable and can be used in most any application where spraying is desired.

18 Claims, 20 Drawing Sheets

FIG.18
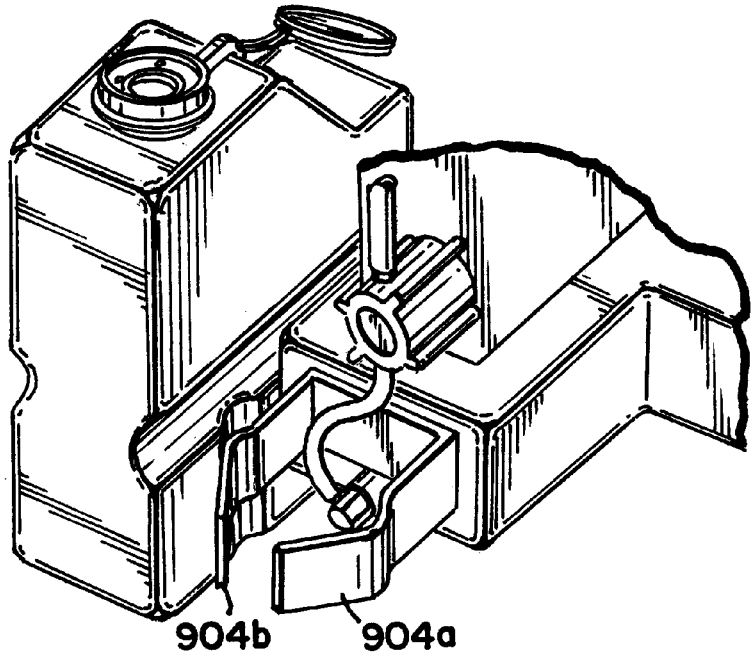
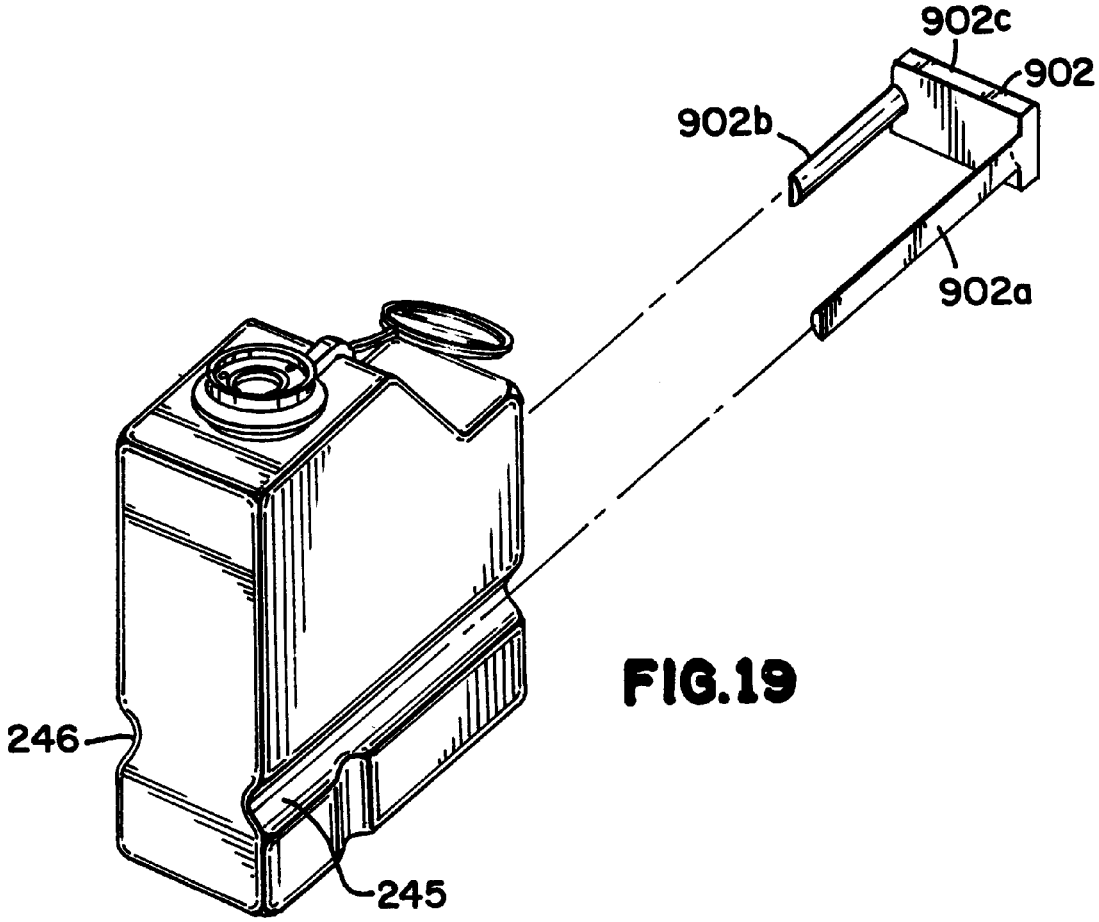
FIG.19

FIG. 24
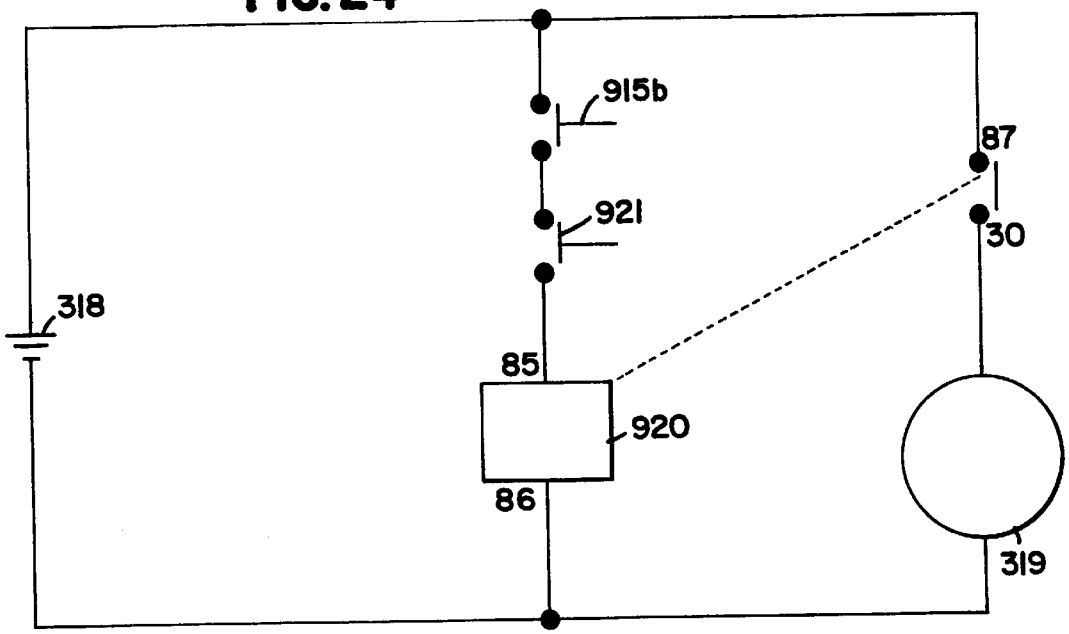
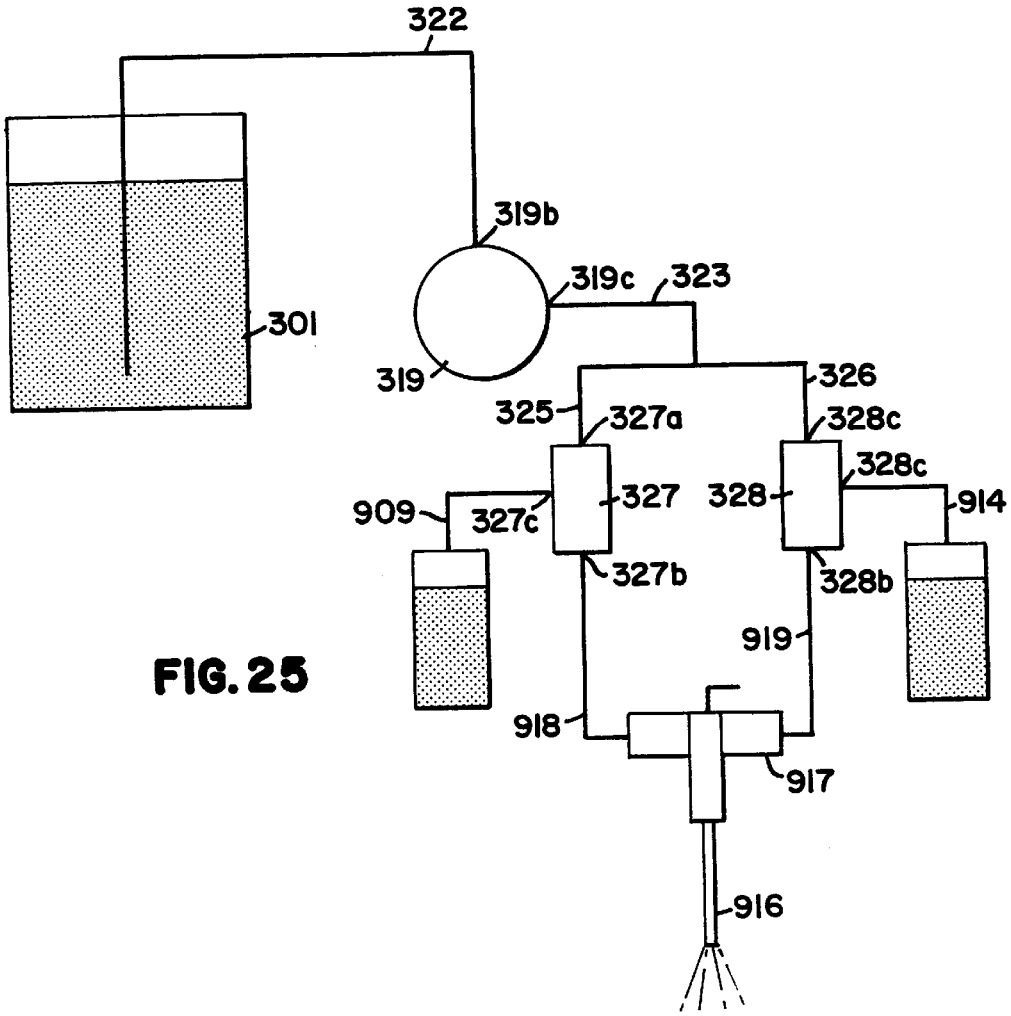
FIG. 25

PORTABLE UNIT WALL UNIT DISPENSERS AND METHOD OF DISPENSING

This application is a continuation-in-part of U.S. application Ser. No. 09/033,229 filed Mar. 2, 1998, entitled "Portable Wash and Rinse System With Dilution" now U.S. Pat. No. 5,996,907.

FIELD OF THE INVENTION

The invention relates to a fully integrated dilution station using a unique combination of mechanical, electrical and liquid elements in a station that combines a diluent with a liquid concentrate to form a composition that is sprayed or formed onto a surface. The dilution station can also pump and spray the aqueous diluent as a spray rinse. The dilution station has a container for the aqueous diluent that is designed and configured to be fillable from a tub spout and to be easily emptied without disassembly when cleaning is finished. The integrated unit has one, two or more sources of liquid concentrate and an associated venturi for diluting and spraying each concentrate. The integrated system is powered by a portable power source such as an electric pump and a rechargeable battery having sufficient electrical capacity to enable a custodial or maintenance personnel to complete a substantial number of cleaning tasks between recharging or replacing the batteries. The invention also relates to the use of a two-directional lockout. Further, the invention utilizes a primary dilution apparatus and the portable unit which acts as a secondary dilution apparatus.

BACKGROUND OF THE INVENTION

In hospitality, hospital and other residential room maintenance, a substantial amount of time is spent by individual maintenance personnel in cleaning bathroom surfaces such as shower stalls, bathtubs, mirrors, vanities and stools. Bathroom maintenance is commonly conducted on a daily basis if the bathroom is in use. Bathroom maintenance can occupy up to 50% of the time required to complete the daily cleaning of the typical hospitality unit. Cleaning a bathroom is highly labor intensive and involves numerous steps in removing gross soils such as paper products including tissues, spills, shampoo, toothpaste containers, etc. After the initial preparation, maintenance personnel apply cleaners from aerosol or pump sprayers to the surfaces in the bathroom. Cloths, scrubbers, brushes, etc. are then used to apply mechanical action to the surfaces and cleaning materials to remove surface soil. Once the cleaners and soils have been applied by the maintenance personnel, the surfaces are often rinsed and manually dried. Such a procedure is time intensive and, under time pressure, often maintenance personnel reduce attention or can skip one or more steps leaving an incompletely cleaned unit. In bathroom maintenance, cleaning materials are most commonly applied using pressurized aerosol sprays and hand pump sprayers. Rinse water is typically taken from the sink or tub and cleaning cloths, scrub brushes and scrub pads are used to implement soil removal. These maintenance problems are present in maintaining public restrooms in service stations, theaters and other comfort and equivalent locations of public access. Further, institutional and commercial restaurant spaces require at least daily (cleaning and maintenance. Further, entryways, windows, food and beverage manufacturing facilities, surgical suites, examining rooms and other locations require cleaning that involve extensive, time-consuming, manual cleaning.

A number of spray systems are known. A large number of systems that can provide a diluted product in a spray form from a concentrate and a diluent have been used in a number of applications. Such systems dispense varied products including adhesives, insecticides, coatings, lubricants and many other varied aqueous and non-aqueous materials. Such products are often blended on site from reactive or non-reactive chemicals and liquid diluents or extenders. In large part, these systems deliver large quantities of materials, have substantially high pressure apparatus that can dispense and are used in painting, agricultural or automotive applications. Such relatively high volume, high pressure pump sprayers are a widely utilized apparatus, for applying a variety of materials, that pose substantial operating problems. The systems are hard to move, difficult to fill, are not applicable to hard surface cleaners or systems, often cannot simply dilute a concentrate, often require a predetermined mix of chemicals, use high pressure pumps, specialized lines and spray apparatus. Levy, U.S. Pat. No. 3,680,786 teaches a mobile cleaning apparatus on a roller frame having an undifferentiated pump and spray portion and a complex system for blending and dispensing liquid materials. Luvisotto, U.S. Pat. No. 4,865,255 discloses a self-contained mobile spraying apparatus for herbicides, insecticides, fungicides, fertilizers and others including an undifferentiated pump and spray system. Fiegel et al., U.S. Pat. No. 5,263,223 disclose an apparatus for cleaning interior surfaces that is a large ungainly device having an undifferentiated pump and spray portion in a non-refillable source of aqueous diluent. Other spraying devices are disclosed in Park et al., U.S. Pat. No. 4,182,491 which discloses a spraying apparatus including a compressed air source, an undifferentiated source of diluent, etc. Horvath, U.S. Pat. No. 3,964,689 discloses a spray apparatus for dispensing a variety of substances. Coleman, U.S. Pat. No. 4,208,013 describes a portable chemical spraying apparatus with a disposable container using compressed air and a preselected chemical composition. Park et al., U.S. Pat. No. 3,900,165 disclose a hand carrier spraying apparatus using pressurized air. Phillips, U.S. Pat. No. 3,454,042 discloses a portable car wash machine using an external water source. Hill, U.S. Pat. No. 3,894,690 describes a complex spraying system for mixing water and a variety of chemicals.

Clark et al., U.S. Pat. No. 4,790,454 discloses a self-contained apparatus, that cannot be easily filled and emptied, used for admixing a plurality of liquids. Further, the pumping section does not contain a differentiated wet and dry portion separating the battery pump and wiring from the wet side of the pump tubing and connectors. Clontz, U.S. Pat. No. 5,421,900 discloses a self-contained battery operated spray unit and method for using the same for cleaning air conditioners. The system comprises containers that are not easily fillable and emptiable and further contains an undifferentiated spray and pumping section in which there is no defined wet and dry portion.

A substantial need exists to improve cleaning processes in the hospitality bathroom and other similar locations of daily manual maintenance. A substantial need exists to reduce the time and effort required to complete such a cleaning process. A substantial improvement in the application of cleaners to hard surfaces is needed to ensure that each bathroom is cleaned satisfactorily for the user. Further, any improvement in productivity will be welcomed by the guests and hotel management.

In addition, the concentrate that is used for cleaning or other purposes is diluted, depending upon the application, cleaning standards of the user, hardness of the water, etc. Therefore, it is necessary to periodically adjust the concentration level of the use solution being dispensed from the portable cleaning system. A typical hotel or similar establishment may have up to fifteen to thirty portable units that are being used simultaneously. If it is necessary to adjust the concentrate level of each portable unit, this is a very time consuming process, expensive, and subject to quality control issues. To make the individual units easily adjustable by the user is not an easy task and leaves open the possibility of having incorrectly adjusted units. Therefore, a system which would adjust for such changes in concentration is needed. The present invention addresses these problems and provides for a two-step dilution method and apparatus for accomplishing this task.

In addition, it is recognized that the invention has applicability to many other areas where the ability to control the concentration of a chemical, or two or more chemicals, through a variety of secondary devices. There are many cleaning and coating product systems which are water dilutable or extendable to which the present application would be applicable. These would include car cleaning and spotting, carpet cleaning and spotting, glass and window cleaning, building exterior applications, airplane cleaning and maintenance, fungicide, disinfectant and insecticide applications, pest elimination spraying, lawn and garden, animal care and application of product for animate surfaces. It is applicable to most spraying applications where portability is helpful.

BRIEF DESCRIPTION OF THE INVENTION

The present invention is a method of providing a final concentration of product dispensed by a secondary delivery/dilution apparatus. The method includes providing a liquid concentrate to be diluted by a liquid diluent. The liquid concentration is then dispensed at a first dilute solution into a bottle. The bottle is inserted into a secondary delivery/dilution apparatus, the apparatus having a reservoir for holding a liquid diluent. The first dilute solution is further diluted to a second dilute solution in the secondary delivery/dilution apparatus. Then, the second dilute solution is dispensed by a user from the portable secondary delivery/dilution apparatus.

The invention is also a system for dispensing a final concentrate of product dispensed by multiple delivery units. The system includes a first dispenser having an aspirator having a liquid diluent inlet, and inlet for liquid concentrate and an outlet for a first dilute solution. The aspirator is readily modifiable for varying the concentration of the first dilute solution. A valve is operatively connected to the aspirator for controlling flow of the liquid diluent from a source of liquid diluent to the aspirator inlet. A first bottle receives the first dilute solution from the aspirator outlet. Multiple portable self-contained delivery/dilution units each comprise the first bottle of the first dilute solution, a fillable and emptiable reservoir containing liquid diluent, an aspirator having a setting for delivering out its outlet a second dilute solution, a pump to control flow into and out of the aspirator and a spray member in fluid communication with the outlet of the aspirator, wherein the second dilute solution is dispensed by a user. Multiple units are each useable by a respective user and wherein a concentration of second dilute solution in each portable unit is controllable by a concentration of the first dilute solution which is readily modified, thereby allowing different concentrations to be used by the portable units without modifying the portable units.

The invention is also a portable self-contained dispensing system that contacts surfaces with a first liquid spray followed by a second spray. The system includes a fillable and emtiable container for a volume of aqueous diluent of less than 10 liters. A dilution section has a drive portion and a wet portion. The wet portion includes a venturi and a wet portion of a pump, wherein a pump intake is in liquid communication between the container and a pump inlet. A pump outlet is in liquid communication between the pump and the venturi. The venturi including a concentrate inlet and the venturi in liquid communication with an outlet. The drive portion of the station includes a battery, drive portion of the pump and sufficient wiring to power the pump. A source of concentrate in liquid communication with the concentrate inlet of the venturi is provided. A spray means is in separate liquid communication with the venturi outlet and another outlet, comprising a valve that can select either a first liquid spray or a second liquid spray, wherein the pump has a pumping capacity of up to about 2,000 to 3,000 mL per second and the system, with the container filled with an effective amount of diluent, weighs less than 7 kg.

The invention is also a portable self-contained dispensing system which includes a fillable and emptiable container for holding an aqueous diluent. A dilution section is operatively connected to the container and includes a pump having an inlet in fluid communication with the container and an outlet in fluid communication with first and second aspirators, each aspirator having an inlet and outlet. A power source is operatively connected to the pump. A first source of concentrate is in fluid communication with the inlet of the aspirator and a second source of concentrate is in fluid communication with the inlet of the second aspirator. A spray member is in fluid communication with the first and second aspirator outlets. A first bottle holds the first concentrate and a second bottle holds the second concentrate. A valve controls the fluid flow from the first and second aspirators, wherein the pump pressurizes flow from both aspirators and the valve locks flow through one of the aspirators as the other of the aspirators operates.

BRIEF DISCUSSION OF THE DRAWINGS

FIG. 1 is an isometric view of one embodiment of the apparatus of the invention. The assembled system is shown with the container, the dilution section having a wet and dry portion and the spray head;

FIG. 2 is an exploded isometric view of the components of the dilution system of the invention. FIG. 2 shows the container for the aqueous diluent, the wet and dry portion of the dilution section and a housing that encloses the dilution section with integral molded handles, locations for switches, a plug for charging the rechargeable batteries, a station for the concentrate container and a holster for the spray head;

FIG. 3 is an electrical diagram of the simple electrical circuit of the system of the invention;

FIG. 4 is an isometric view of a second embodiment of the apparatus of the invention. The assembled apparatus has two sources of concentrate. For each concentrate the apparatus has tandem venturis (energized by one or more pumps), diluent tubes and connections to the spray wand. The wand is valved for spray of the selected diluted concentrate or the aqueous spray. The container or bucket portion has a separate wet and dry portion for the liquid diluent and electrical components;

Figure 7:
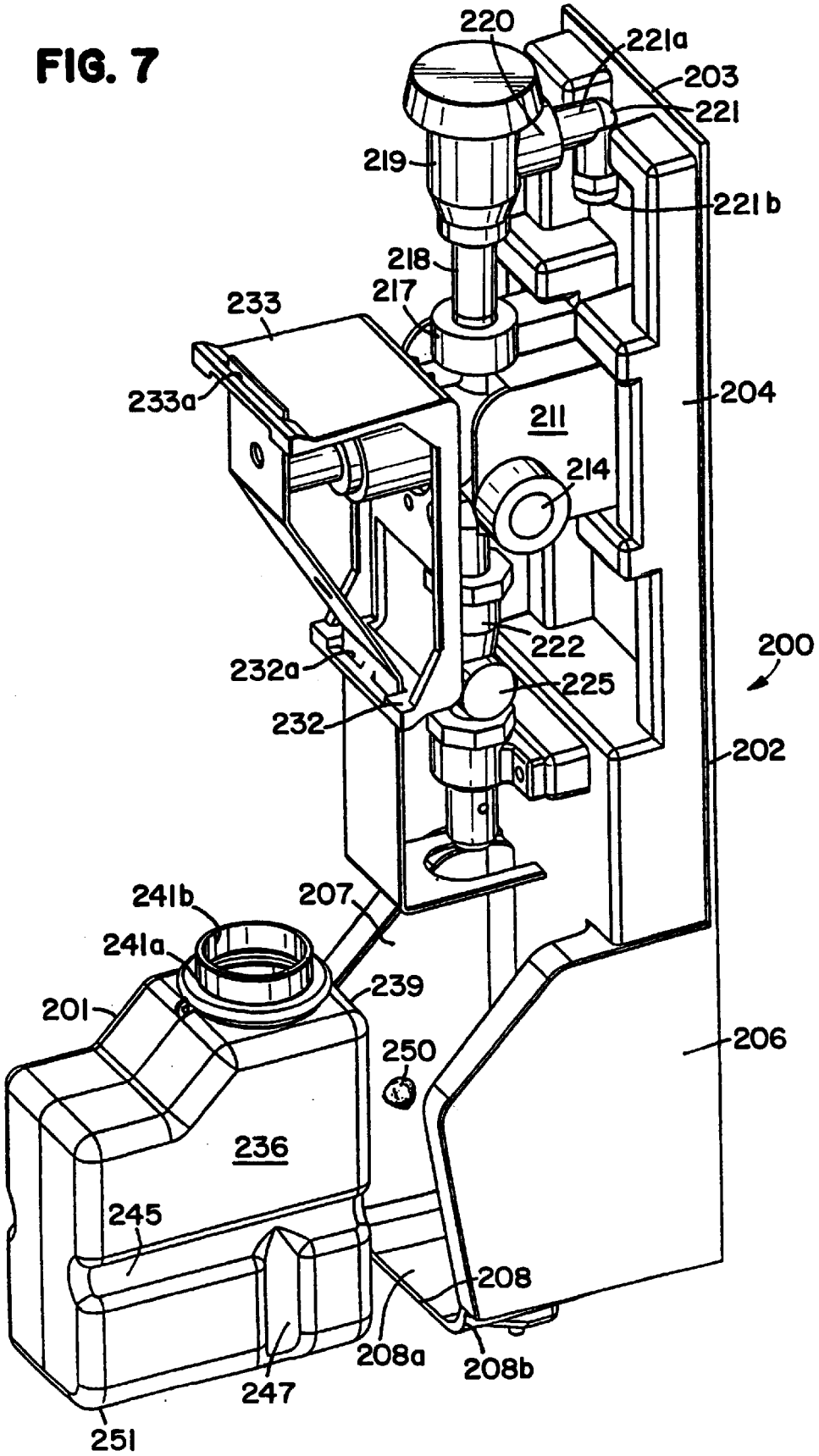
Figure 8:
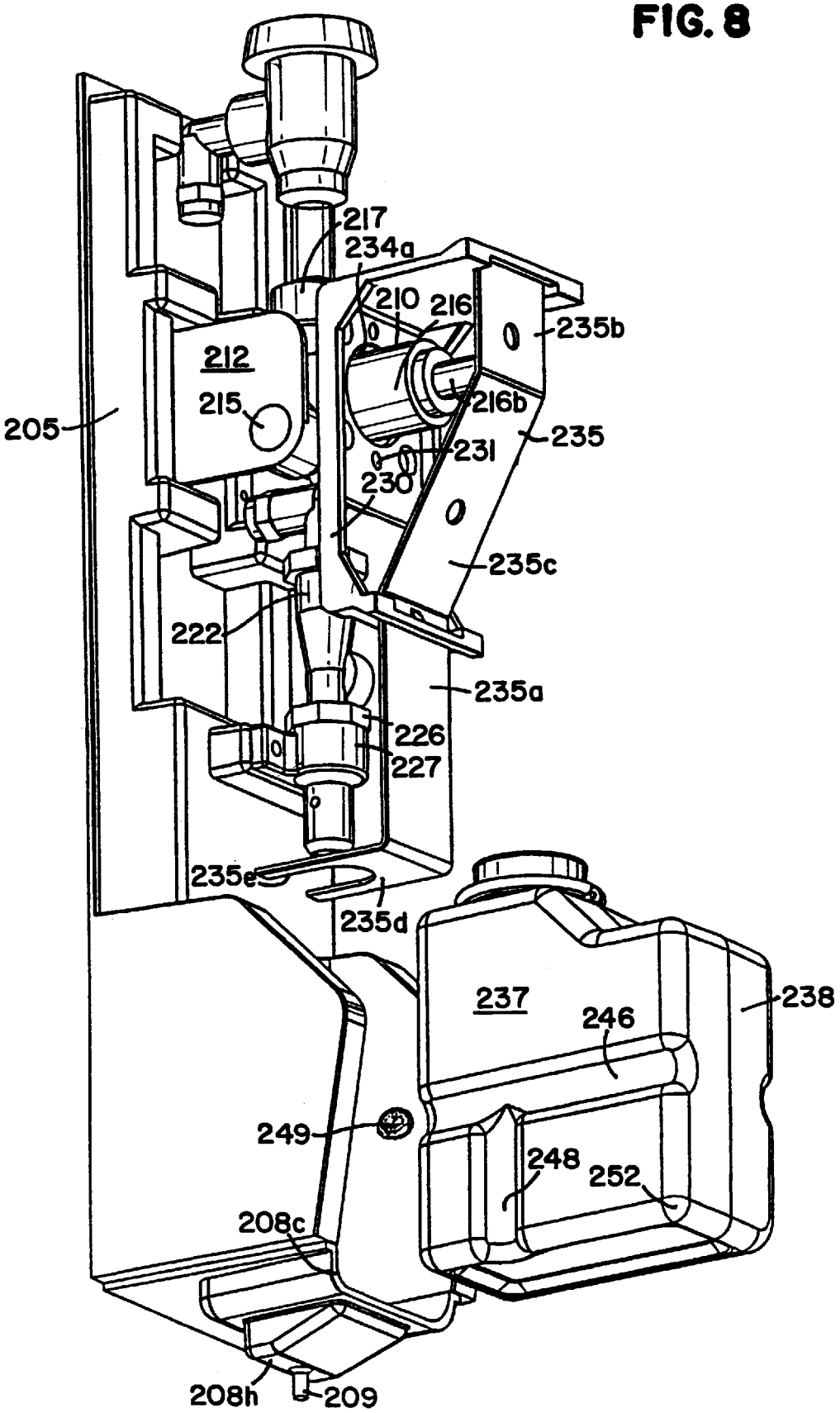
Figure 9:
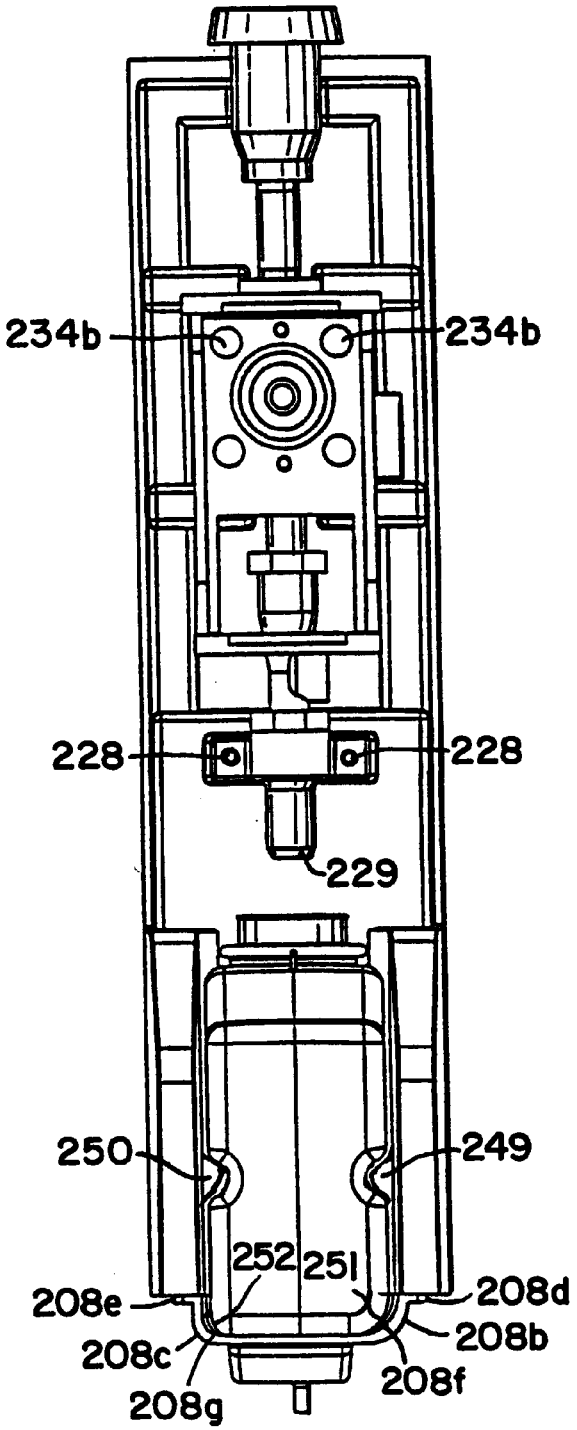
Figure 10:
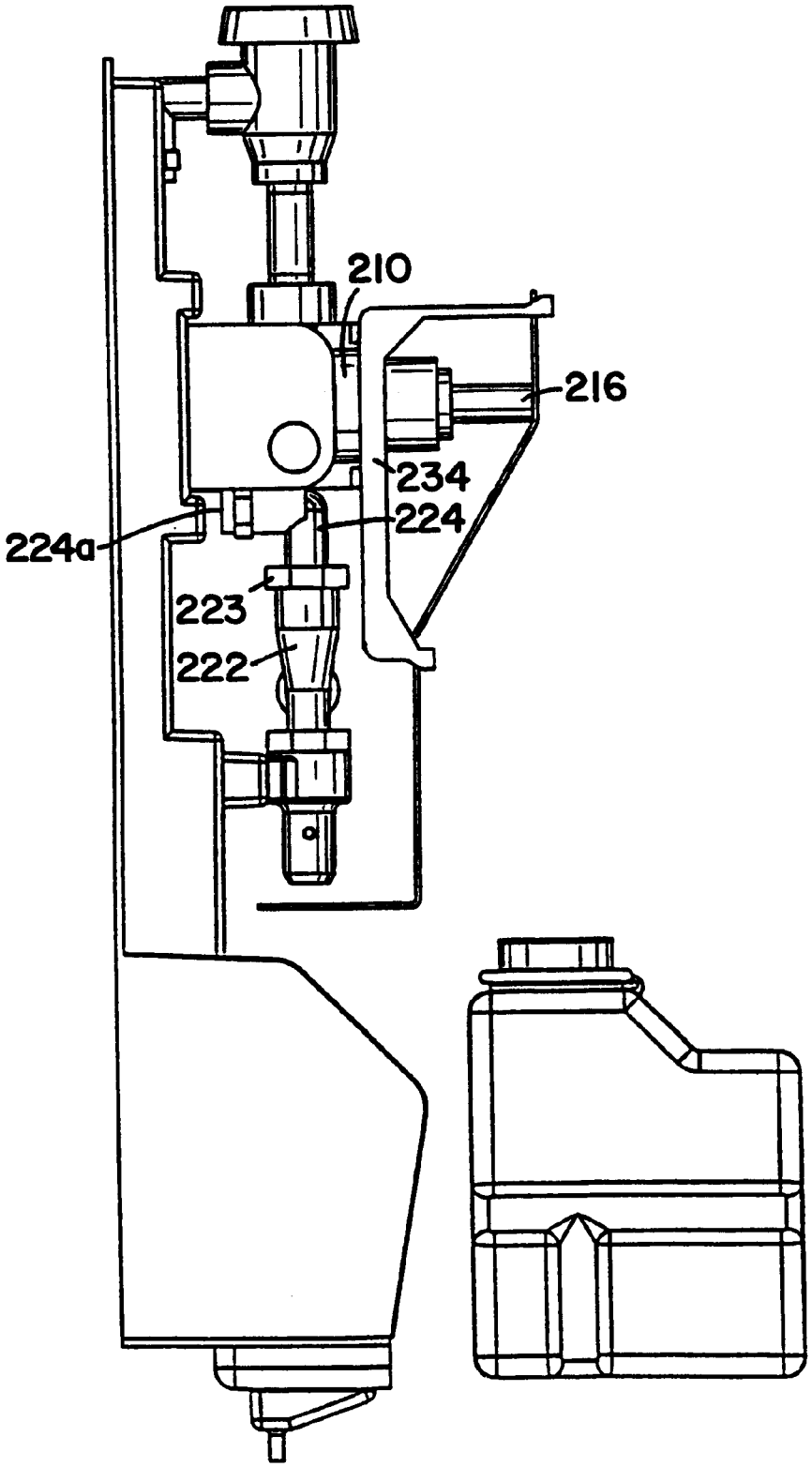
Figure 11:
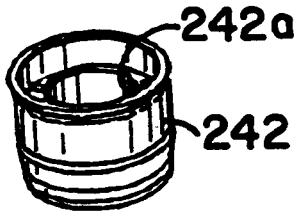
Figure 12:
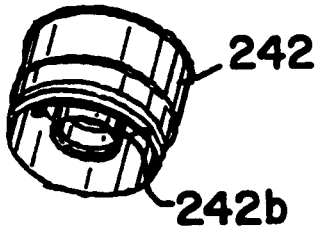
Figure 13:
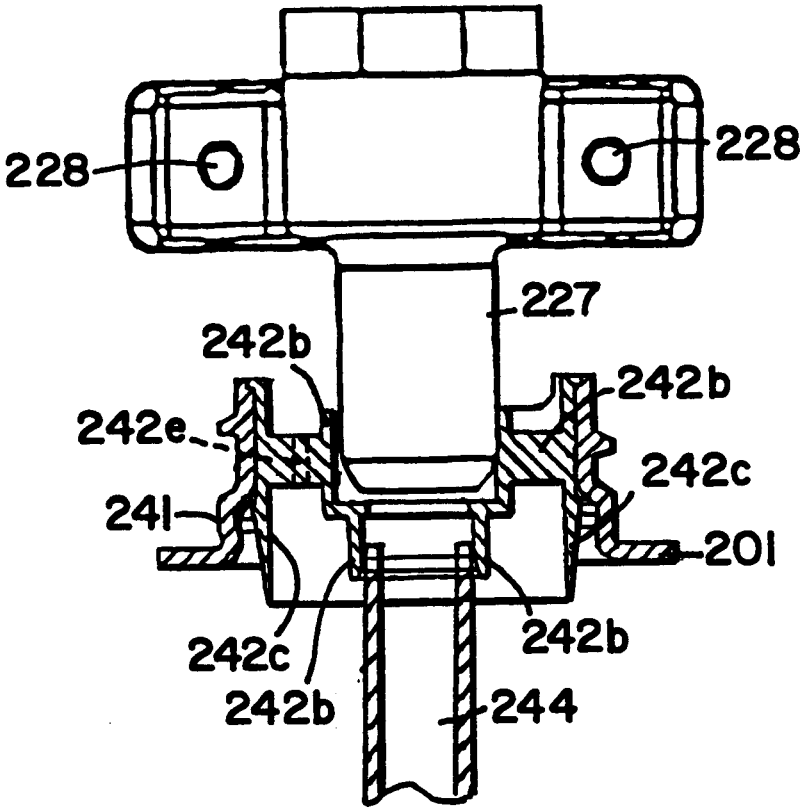
Figure 14:
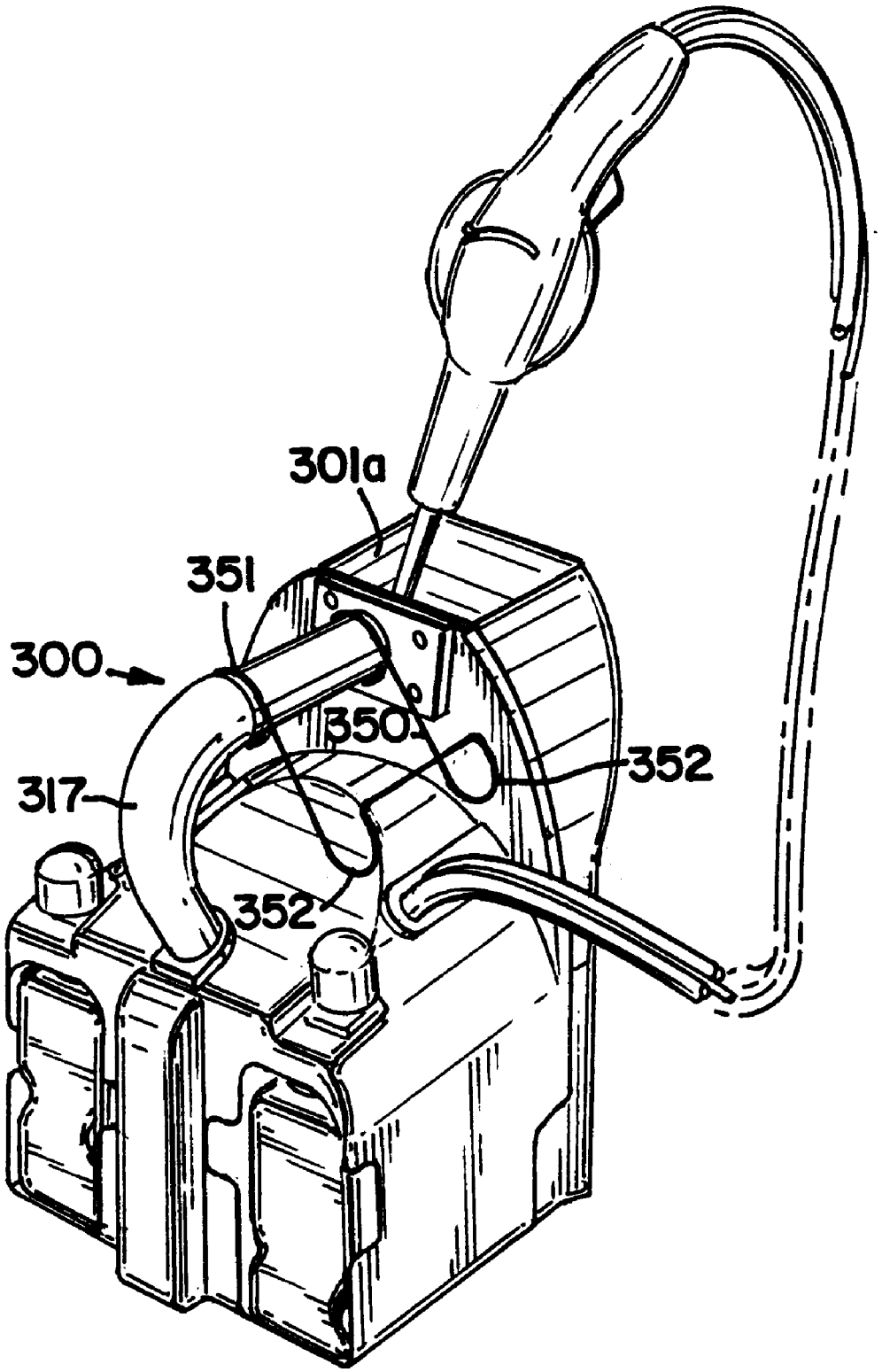
Figure 15:
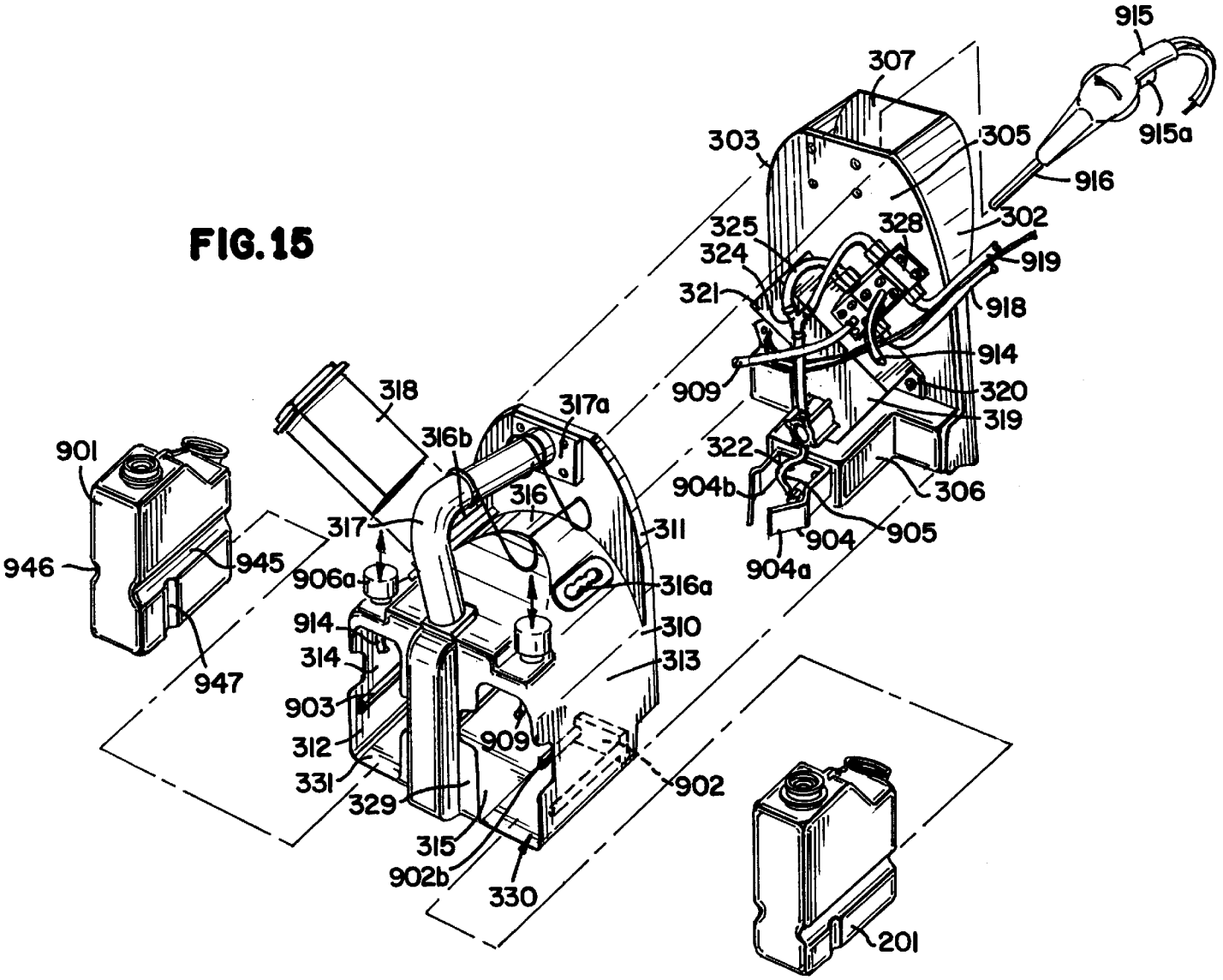
Figure 16:
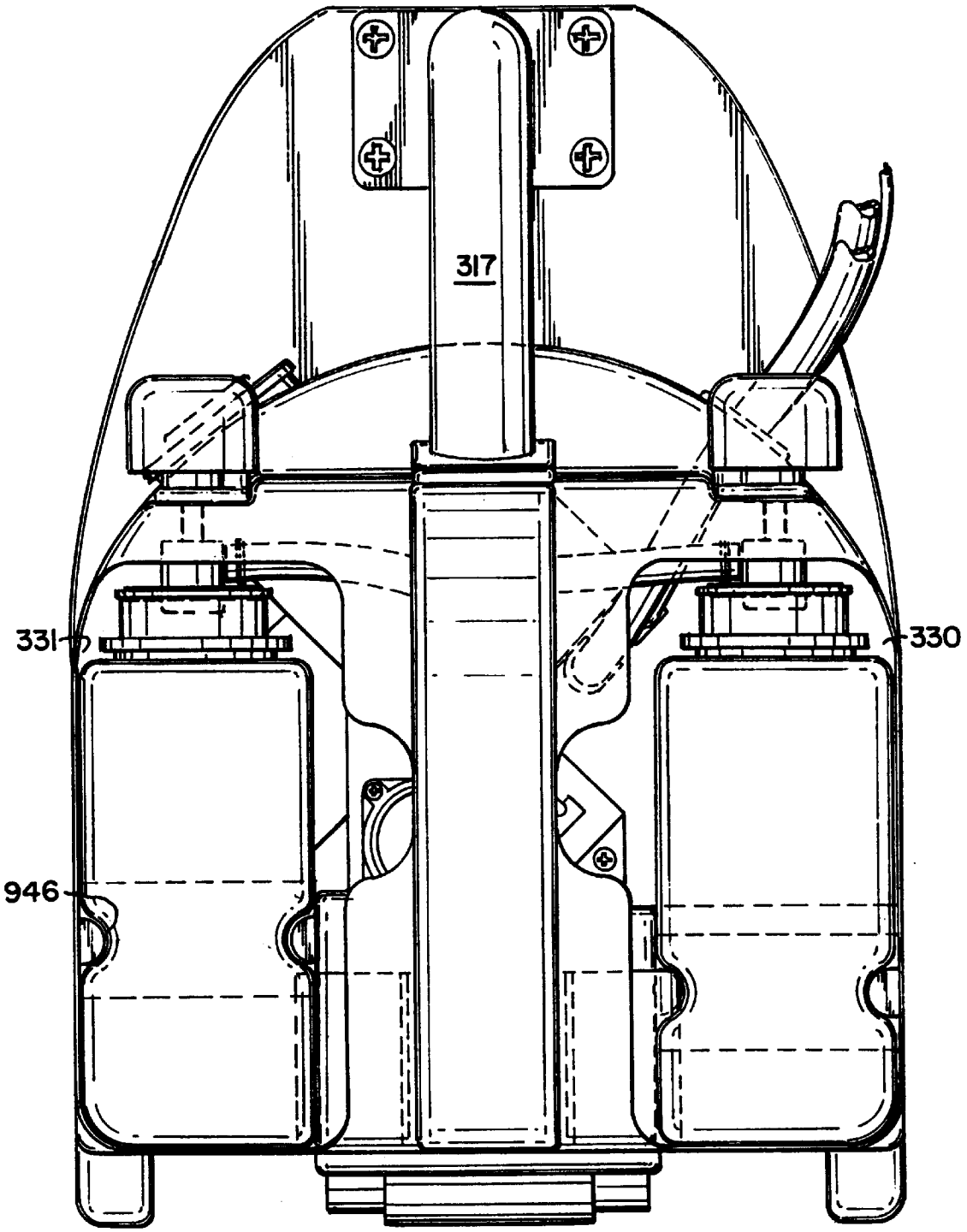
Figure 17:
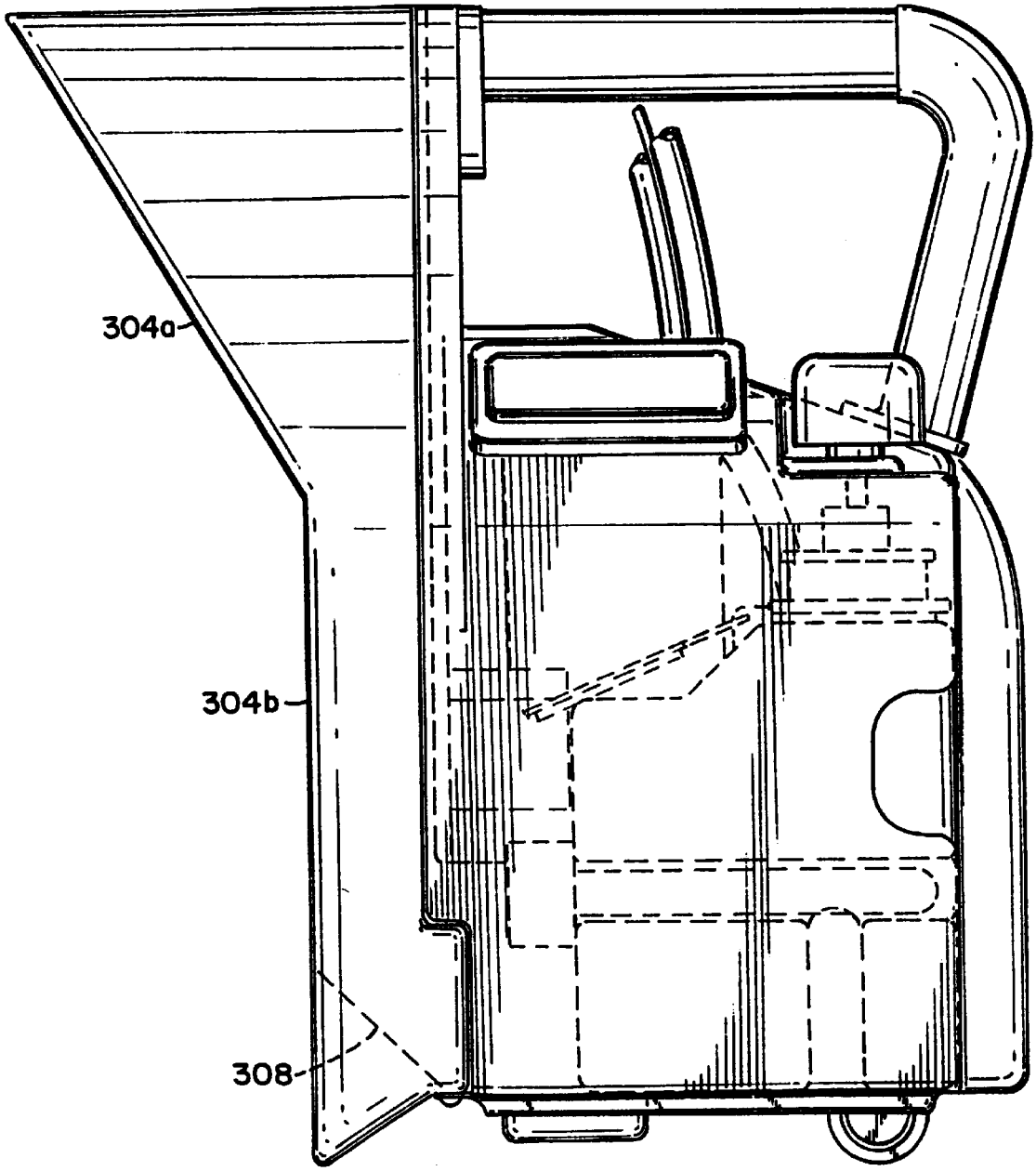
Figure 20:
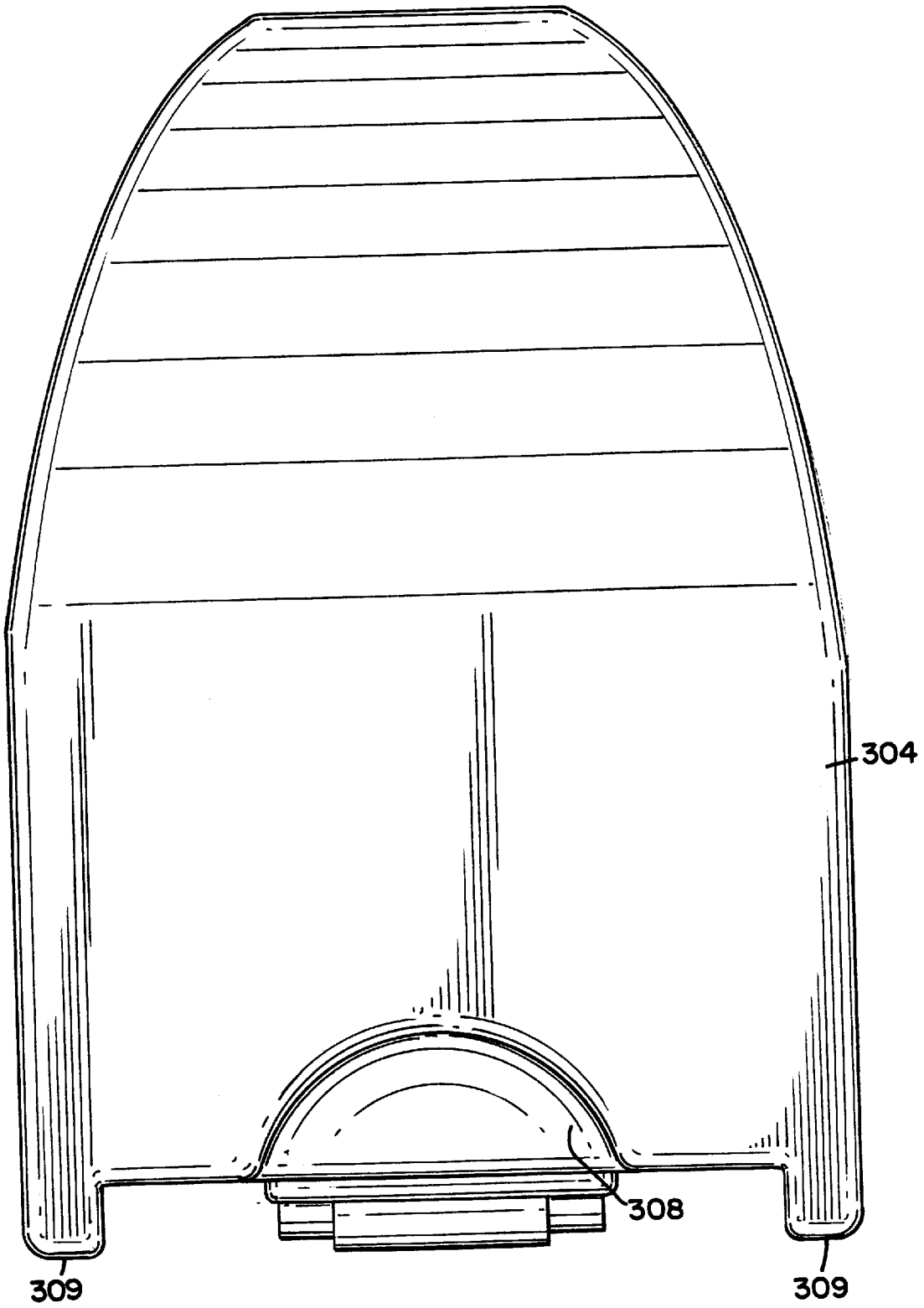
Figure 22:
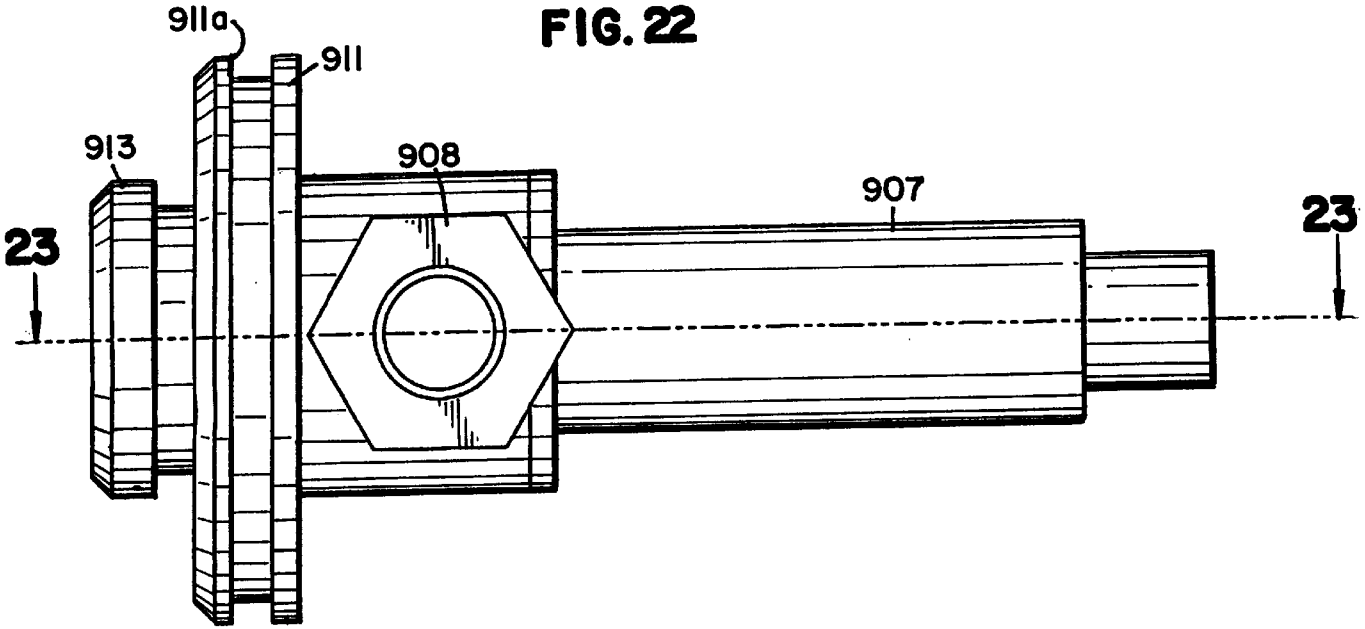
Figure 21:
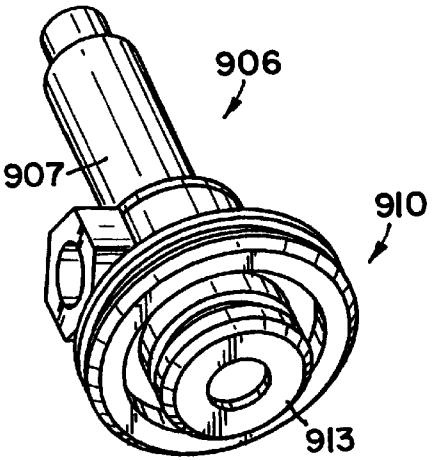
Figure 23:
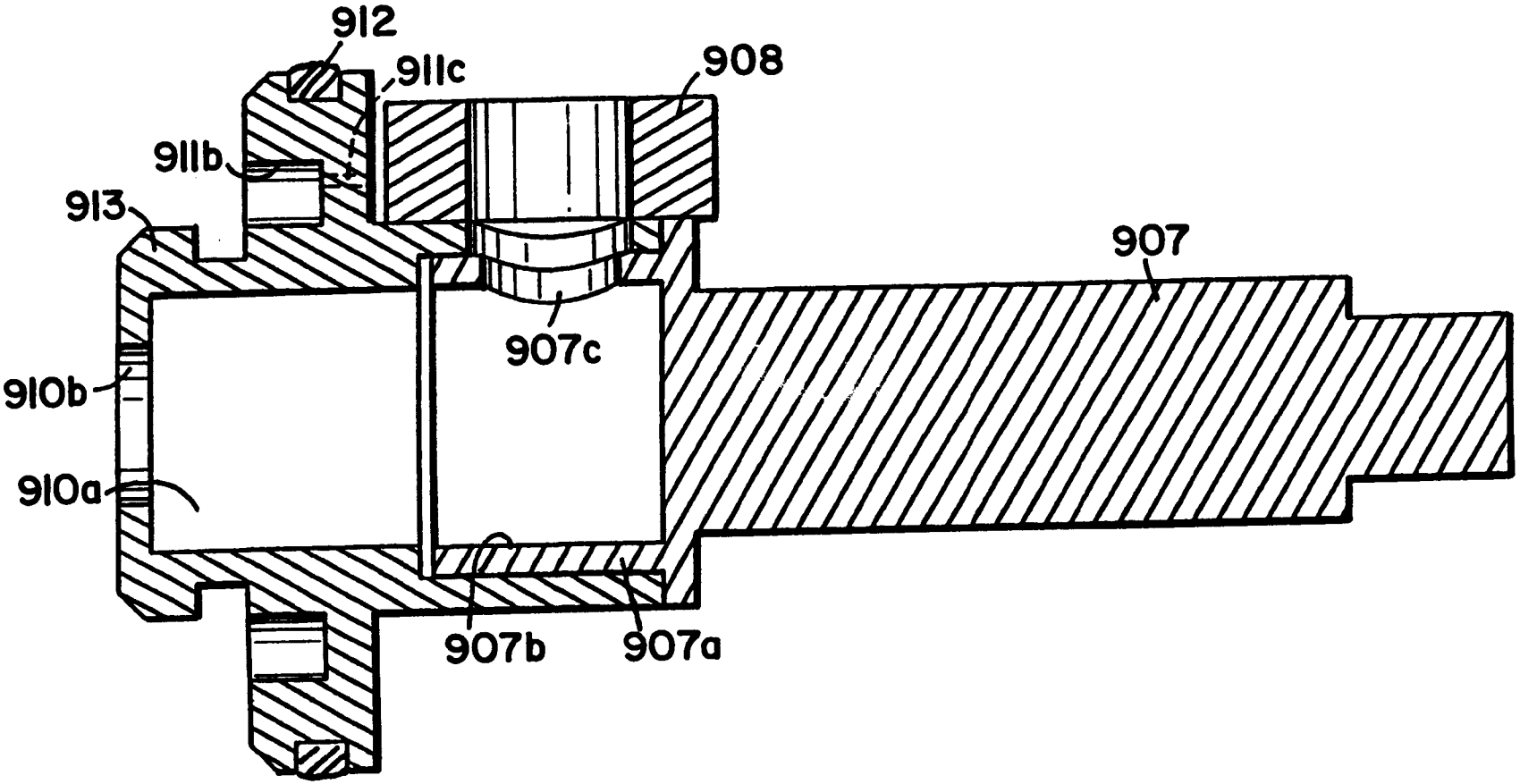

6 shows a tandem apparatus for diluting and spraying the liquid concentrate;

FIG. 7 is a perspective view of the wall-mounted liquid dispenser of the present invention shown generally from above and to the right;

FIG. 8 is a perspective view of the liquid dispenser shown in FIG. 7, viewed generally from below and the left;

FIG. 9 is a front plan view of the dispenser shown in FIG. 7, with the slide removed for clarity purposes;

FIG. 10 is a side elevational view of the liquid dispenser shown in FIG. 7;

FIG. 11 is an exploded perspective view of an insert, viewed generally from above, which goes into the bottle;

FIG. 12 is an exploded perspective view of the insert, as shown in FIG. 11, generally shown from below;

FIG. 13 is a cross-sectional assembled view of the insert shown in FIG. 11;

FIG. 14 is a perspective view of another embodiment of the present invention;

FIG. 15 is an exploded perspective view of the embodiment shown in FIG. 14;

FIG. 16 is a rear elevational view of the embodiment shown in FIG. 14;

FIG. 17 is a side elevational view of the embodiment shown in FIG. 14;

FIG. 18 is a partial perspective view of a portion of the embodiment shown in FIG. 14;

FIG. 19 is a perspective view showing the lockout feature of the embodiment shown in FIG. 14;

FIG. 20 is a front elevational view of the embodiment shown in FIG. 14;

FIG. 21 is a perspective view of the fitment used in the embodiment shown in FIG. 14;

FIG. 22 is a front elevational view of the fitment shown in FIG. 21;

FIG. 23 is a cross section of the fitment shown in FIG. 22, taken generally along the lines 23—23;

FIG. 24 is a schematic drawing for the embodiment shown in FIG. 14; and

FIG. 25 is a flow chart of the embodiment shown in FIG. 14.

DETAILED DISCUSSION OF THE INVENTION

Figure 1:
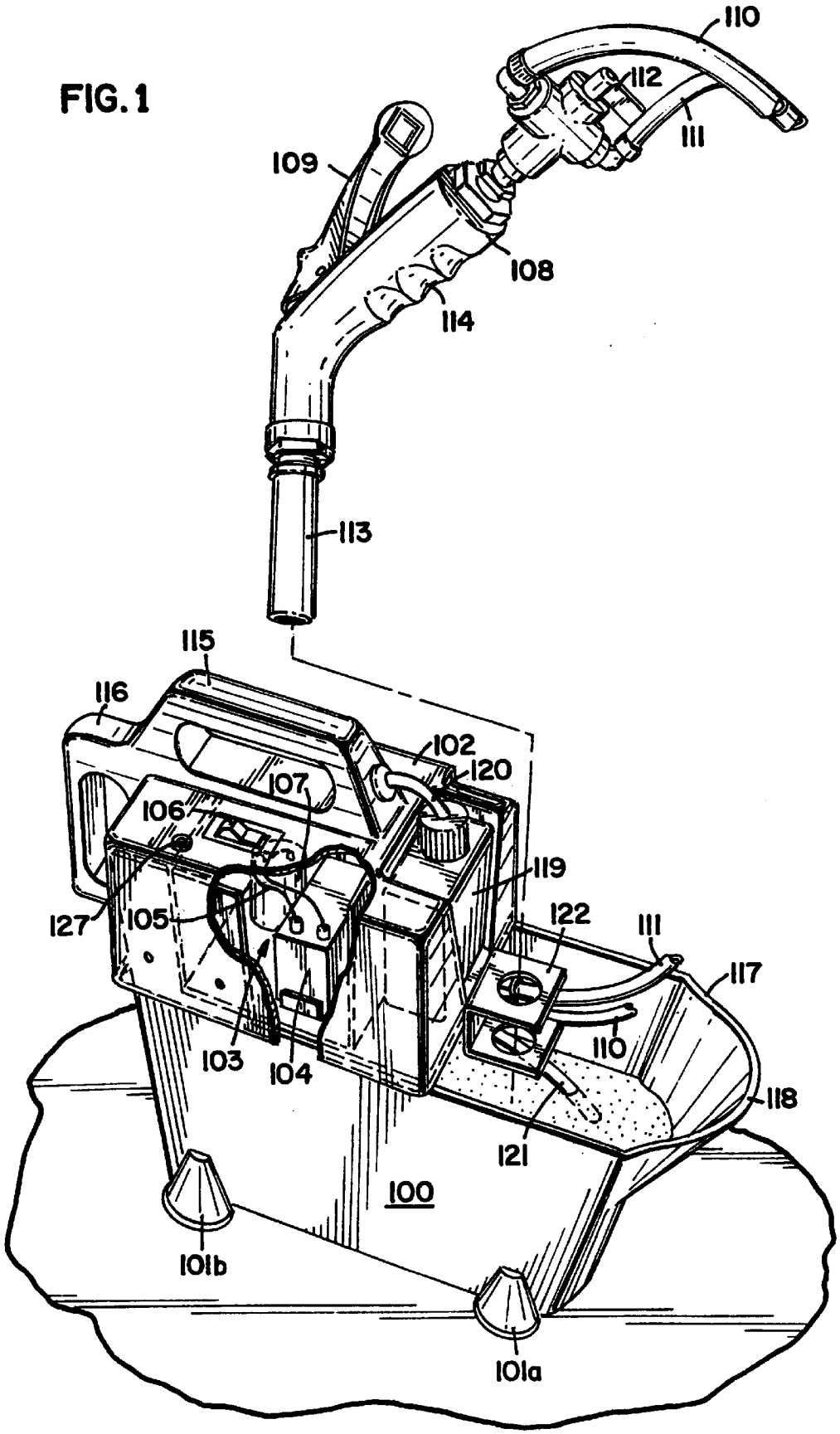

FIG. 1 shows a spray head 113 connected to the pump output of the dilution section. Two sources 110 and 111 are shown for the diluted concentrate and the rinse. The spray is energized by compressing handle 109 which permits either rinse or diluted concentrate to exit the spray head in a spray pattern. The rinse or the diluted concentrate is selected using valve 112. The spray head is typically constructed from conventional metallic and thermoplastic materials. The spray head can be adapted for one, two or more diluted concentrate streams and a rinse stream. The selection of the rinse or diluted concentrate stream can be made at valve 112 in the spray head or in the dilution section 102 by selecting the appropriate concentrate and venturi. The dilution system of the invention includes a container 100 for an aqueous diluent such as service water. The container is typically a molded unit made from a thermoplastic material. Such a unit can be injection molded, vacuum molded or shaped using a variety of conventional thermoplastic processes.

The container 100 is manufactured with an integral base portion 101*a*, 101*b*, etc. to provide a stable positioning of the device in a workplace, in a tub, or in a utility closet. The container has a volume of about 2 to 8 liters, preferably 3 to 6 liters. Such a size permits ease of use, easy transportation from place to place and rapid filling and emptying. Further, the limited capacity of the container limits the weight of the unit to less than 40 lbs (18 kg) preferably less than 25 lbs (10 kg) for easy portability. In normal use to avoid spills, the container can be filled to a fraction of the maximum capacity and can contain an appropriate volume of diluent without filling the container to its maximum depth. The container should have at least 4 and up to 8 centimeters of clearance between the top of the diluent liquid and the upper edge of the container.

When assembled, the dilution system of the invention exposes an open portion of the container. This portion exposes a sufficient area of the upper edge of the container such that water can be easily added to the container from an available source of service water. In use, the apparatus can be placed in a tub, sink, shower, utility closet or other location adjacent to a spout or other source of service water. The service water can be directly added to the container to the desired volume. After the dilution system is used to maintain or clean a single bathroom, the remaining contents of the container can then be emptied to a tub, sink or other disposal location to permit the ease of transport of the system to the next location. In order to permit ease of use of the system of the invention, the container has a portion of the upper edge of the container adapted to pouring or disposing the liquid contents of a container into a tub or sink with minimal spilling, dripping, etc. Preferably, the container can have a lip or spout integrally molded into the container to promote ease of disposal.

Figure 2:
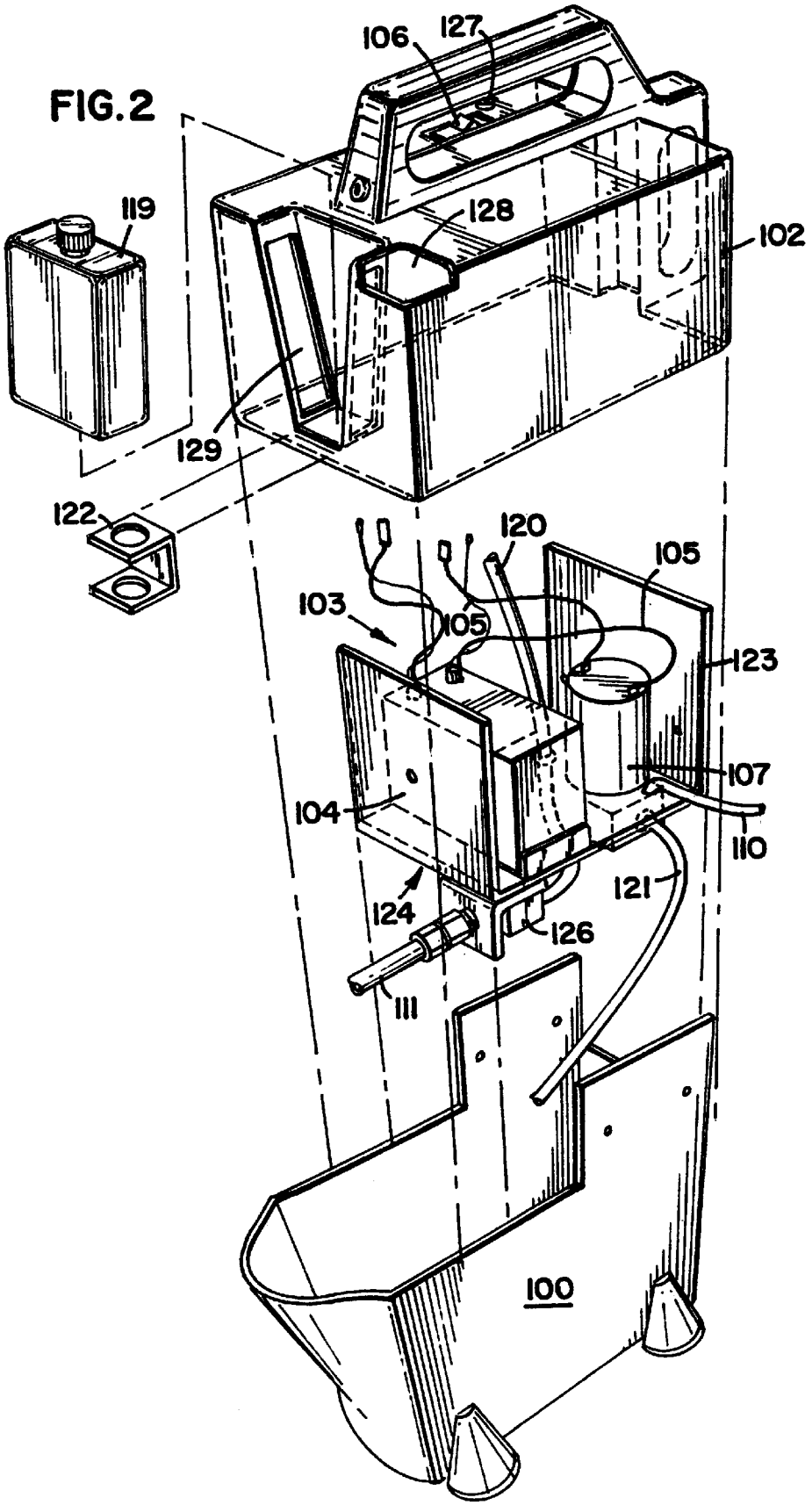

In FIGS. 1 and 2, the dilution section of the dispenser of the invention is shown with a housing 102 over the active components of the apparatus and specifically the dilution section. The housing, similar in formation to the container, is a single part shell molded of a thermoplastic material. The housing has integrally molded handle 115, 116 for ease of transportation, integrally molded stations for the electrical switch 106, the charging plug 127 or docking station for the rechargeable batteries 104, a molded mounting section 129 for the concentrate solution 119 and, if needed, a mounting location 128 for the spray head.

The liquid concentrate container is typically shaped in a rectangular format that is press fit into the mounting site 129 the housing. The volume of the container is about 250–750 milliliters. The concentrate container is shaped and adapted to be press fit and securely mounted into the housing at location 129. The container 119 is connected in liquid communication with a pump inlet to draw the concentrate for dilution purposes.

In assembling the dilution apparatus of the invention, the dilution section 124 is typically mounted on or above the container not in contact with the diluent. The dilution section has a partition 123 which separates the dry portion from the wet portion. The partition 123 cooperates with the container 100 walls to form a protective barrier between the wet section and the dry section containing the electrical components protecting the electrical components from water damage. The housing is then fit over the dilution section installed in the container and is fixed in place typically using conventional mounting means. The wet section containing the pump, tubes, venturi, and other components that come into contact with the concentrate, the diluent, or components that move those fluids.

The dilution system of the invention comprises a container with a base made of molded legs 101*a*, 101*b*. The dilution system has a housing for the dilution section positioned above the container. The dilution section having a wet portion (not shown) and a dry portion containing rechargeable battery, wiring and connections, a switch, pump connections and other electrical components that are typically kept separate from the water contents of the container. The dilution system of the invention also contains a spray wand containing a valve system for initiating spray, a source of diluted cleaner concentrate and a source of aqueous rinse. The choice of rinse or aqueous diluted concentrate is made using valve 112. The spray wand has a spray head which can provide a variety of spray patterns including a fan pattern, a cone pattern, a direct linear spray. Each spray pattern can be driven in a variety of directions with respect to the position of the spray. The spray can be directed away from the spray head, at a 90° angle from the spray head or any other arbitrary angle in between. The spray can also be directed above, below or to either side of the spray judged from a position of a person holding the spray wand using the molded spray hand hold 114.

When used by maintenance personnel, the unit is grasped by handle or and moved from place to place within the cleaning locus (i.e.) a hospitality or hospital location. The unit is typically placed in a tub or on the floor and filled through opening with sufficient service water or aqueous diluent to service a single bathroom or other location. The container is adapted with an opening and spout to ensure that the container can be easily filled with water or aqueous diluent without disassembling the dilution system apparatus. The apparatus contains a source of liquid concentrate that is placed in liquid connection with the dilution system through tube. When used, the system having source container filled with concentrate and container filled with aqueous liquid, maintenance personnel energizes switch which drives aqueous liquid through tube into the pump. The aqueous liquid leaves pump 107 is driven through a venturi 126 (see FIG. 2) which draws aqueous liquid from source container 119 into the aqueous liquid forming a diluted concentrate. The diluted concentrate is then driven through tube 111 into the spray head 108. Sufficient diluted concentrate is delivered to clean the target surface and the switch 106 is turned off terminating flow of the aqueous liquid and the dilute material. A valve 112 is then switched to a rinse position, the switch is energized drawing aqueous liquid from the container 100 through tube 121 into the pump through tube 110 and out of the spray head to rinse cleaner and soil from the target surface. Once rinsing is complete, the pump switch 106 is turned off terminating the flow of aqueous liquid from the container. The system can be used repeatedly in a bathroom or other room until maintenance operations are finished. At that time the system can be emptied of the aqueous diluent from container by simply pouring the liquid from the container through spout typically into the tub, stool or sink. When the spray wand is no longer in use, the spray wand can be inserted into the holster bracket.

FIG. 2 is an exploded view of the dilution system of the invention. The view shows three major components; the container, the housing and a partition which separates the housing into a wet portion and a dry portion 103. The wet portion on the side of the partition proximate to the container contains the wet portion of the pump, the water intake 121 to the pump 107, the venturi 126 and other portions of the dilution system requiring or permitting contact with water or other aqueous liquids. The dry portion 103 contained within partition comprises the rechargeable battery, the electrical part of the pump, wiring connections 105 to the switch. The housing contains a plug-in 127 for charger apparatus for charging the rechargeable battery. The housing can also contain a holster bracket or a spray wand holder portion in the housing. The bracket or the holder portion can provide storage for the spray wand when the spray wand is not in use. Housing also has a mounting location for the liquid container.

Figure 3:
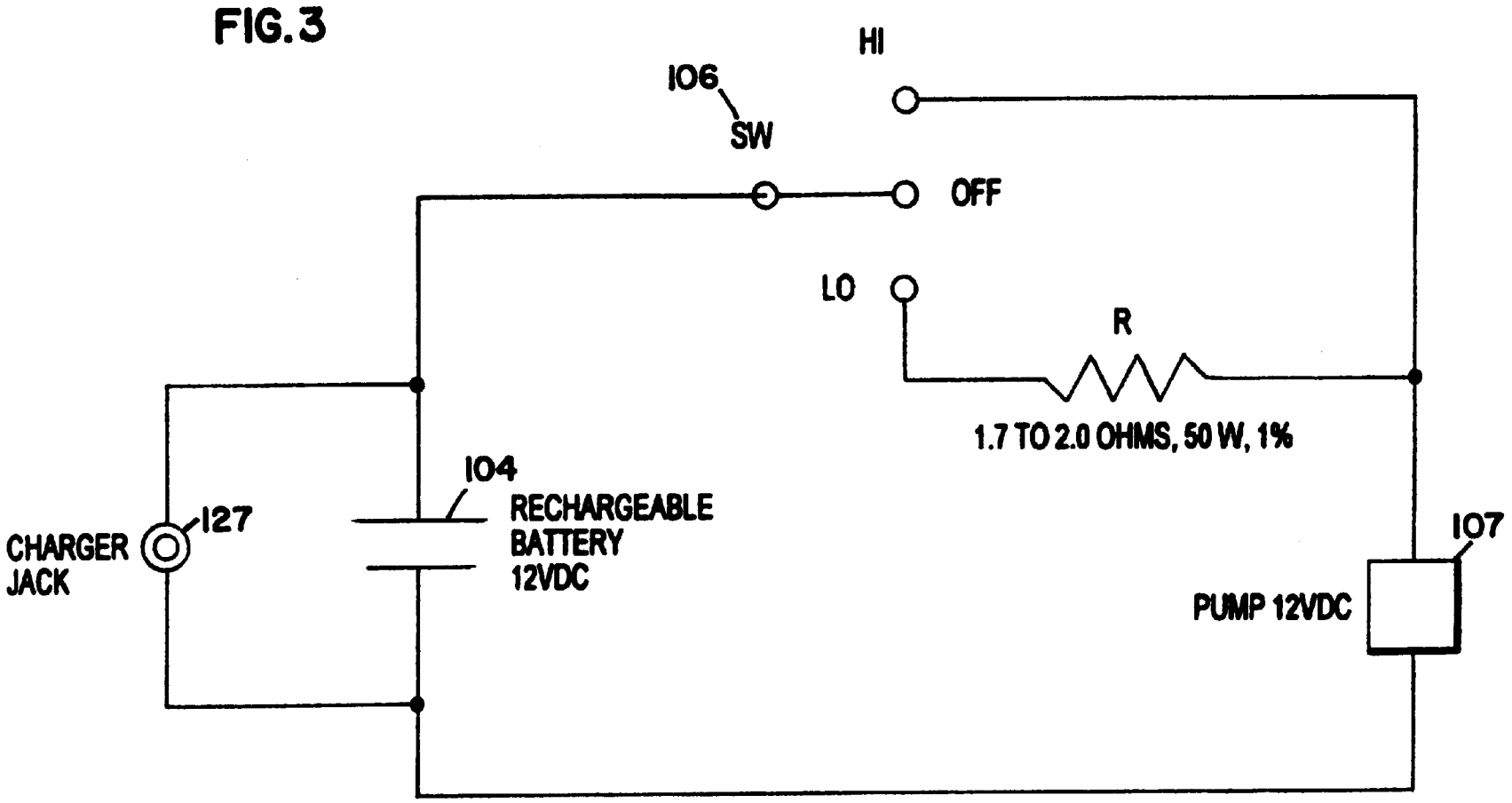

FIG. 3 is an electrical wiring circuit diagram for the dilution system in the invention. The circuit diagram shows the wiring pattern connecting electrically the components of the invention. The charger jack 127 is shown in parallel connection to the rechargeable battery 104. A removable rechargeable battery can be used to energize the system. The multiposition switch 106 has a low and/or a high pumping speed position. The pump 107 is connected to the rechargeable battery directly for the high speed and through a step down resistor for the low speed setting.

The container 119 can contain from 250–750 milliliters of an aqueous or non-aqueous liquid concentrate that can be diluted with the service water in container 100 to form a functional cleaning material for use on surfaces common in the cleaning environment.

Figure 4:
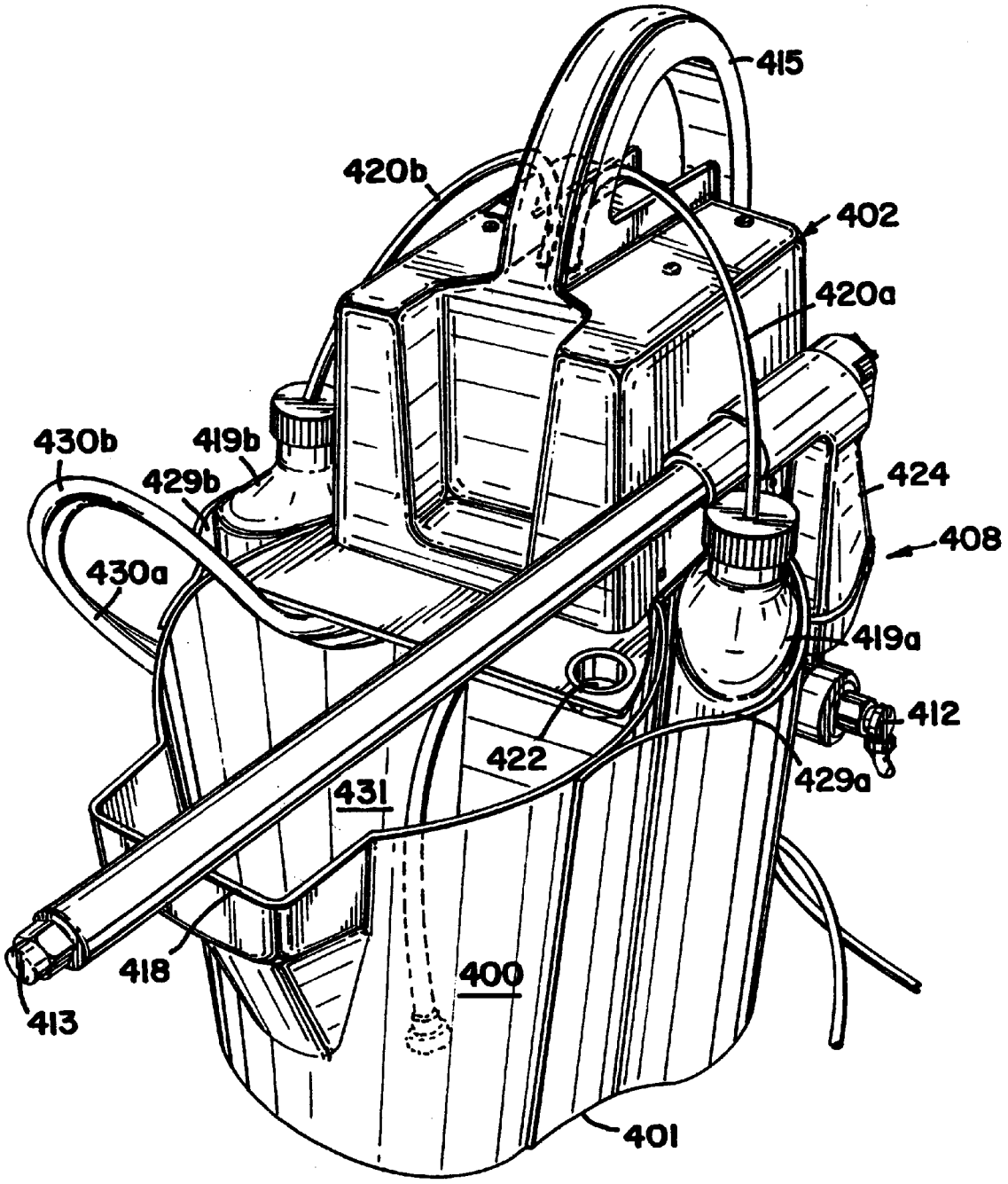

FIG. 4 shows a second embodiment of the invention having two sources of liquid concentrate 419*a* and 419*b* in formed stations 429*a* and 429*b* attached to container 400. Container 400 is divided into a wet section 431 and a dry section 403 (see FIG. 5). Container 400 has a base 401, that can have feet (see feet 101*a* FIG. 1) that permits fluid flow under the unit, that is flat and maintains a reliable placement. Container 400 also has a spout 418 that permits easy filling and emptying of the aqueous diluent. The apparatus comprises a spray wand 408 having a handle 424 and a spray nozzle 413. The diluted concentrate is directed to the wand by conduits 430*a* and 430*b*. The spray nozzle 413 is valved with valve 412 to select either concentrate of container 419*a*, concentrate of container 419*b* or the aqueous diluent in the dry section 431. The electrical components (not shown) are covered by shell 402 that also incorporates a handle 415 and a wand station 422. Concentrate from containers 419*a* and 419*b* are directed into the diluent station through lines 420*a* and 420*b*.

Figure 5:
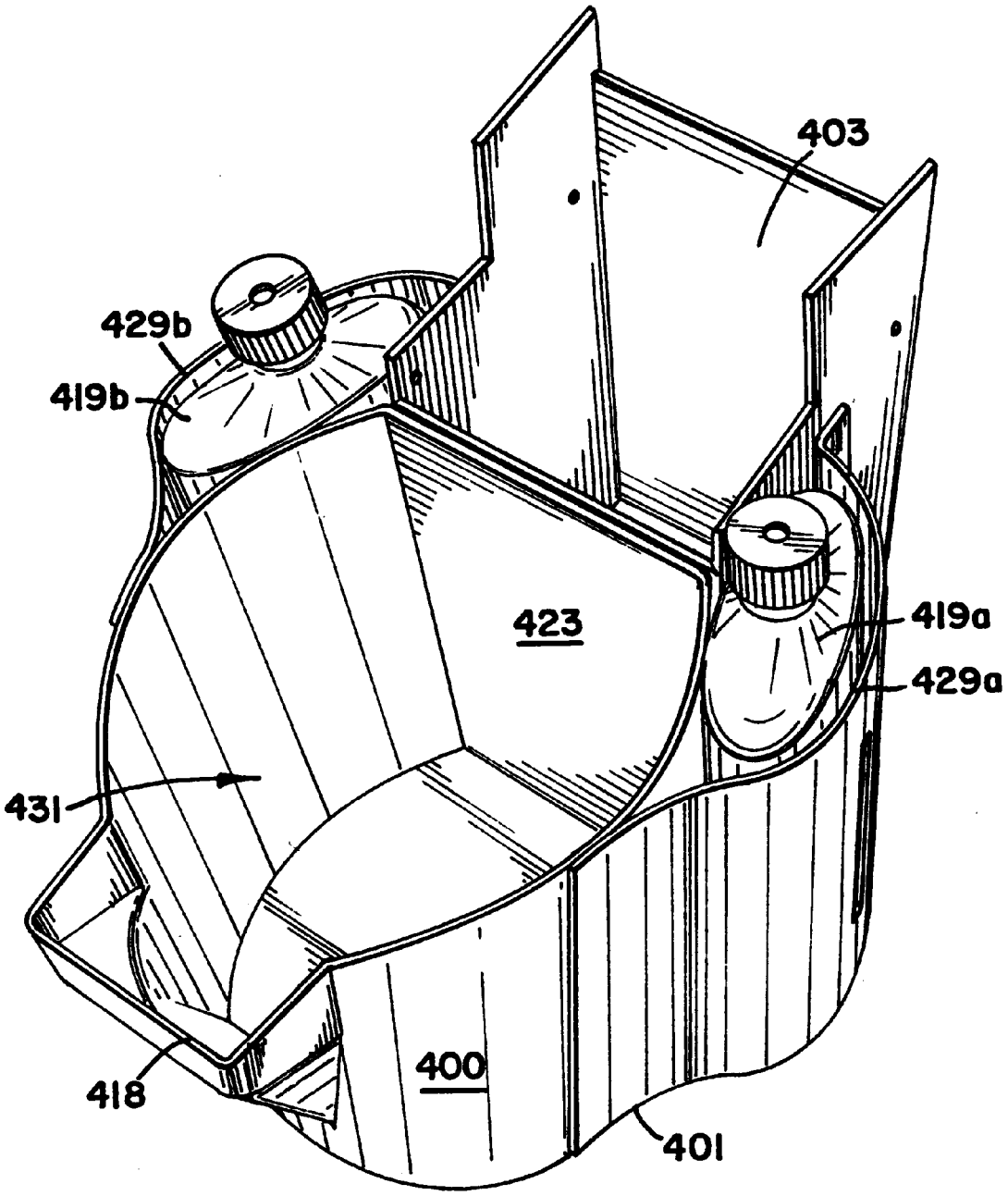
FIG. 5 is an isometric view of the lower portion of the apparatus of the invention with the electrical components and tubing components in an upper portion, removed. Two areas are shown in FIG. 5.

FIG. 5 is an isometric view of the container 400 having wet section 431 and dry section 403 separated by a separation or wall 423. The concentrate containers 419*a* and 419*b* are shown in their mounting locations 429*a* and 429*b*.

Figure 6:
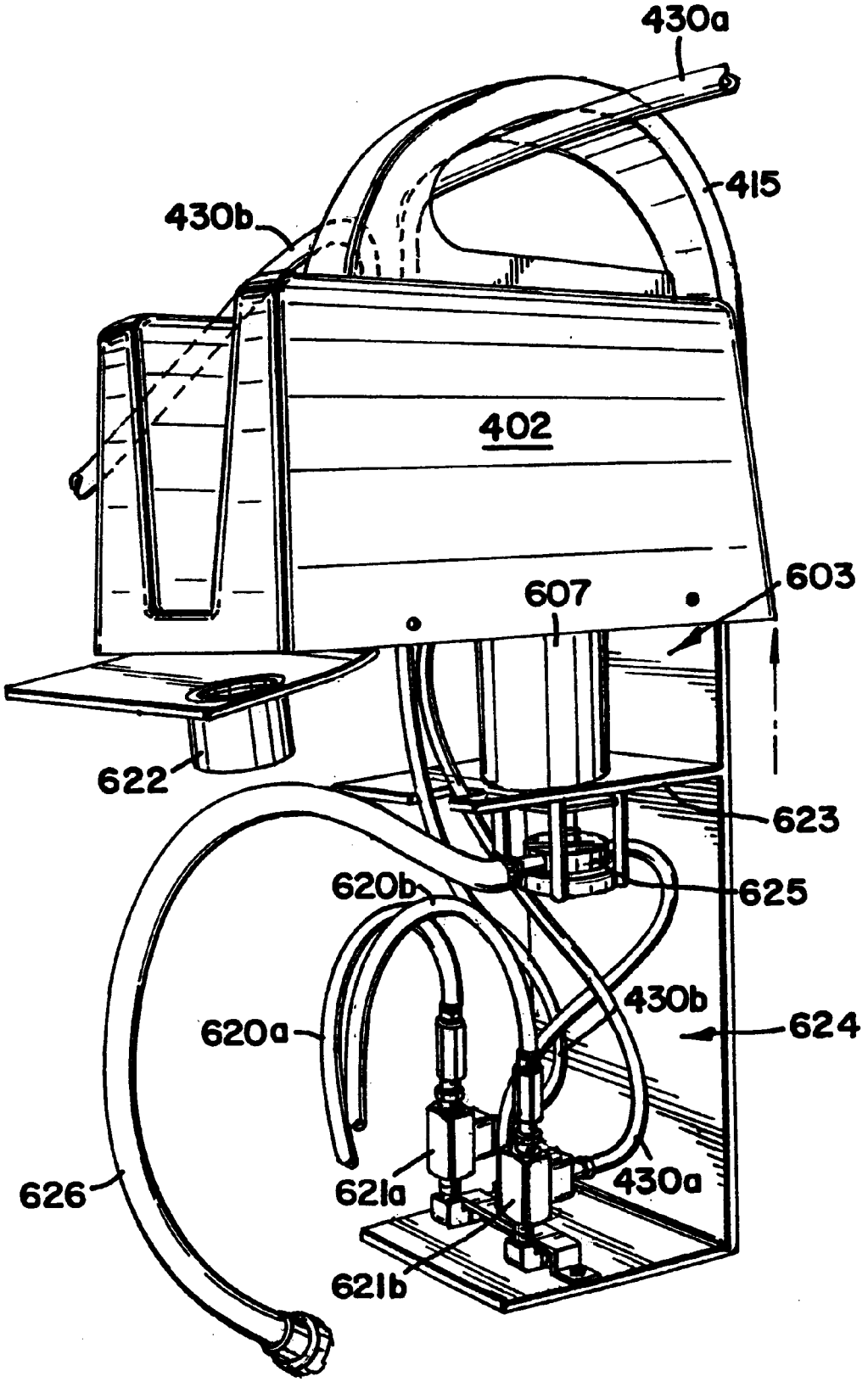
FIG. 6 is a side view of the apparatus of the invention having a lower wet portion and an upper dry portion. FIG.

FIG. 6 shows the active portion of the portable system showing a dry section 603 and a wet section 624 separated by a separation of wall 623. Housing 402 is pulled from the dry section 603 to reveal the motor 607. Not shown in the dry section is the rechargeable battery and wiring. In housing 602 is shown handle 415 and wand holder 622. In the operation of the device, liquid concentrate is drawn through tubes 420*a* and 420*b* into venturi 621*a* and 621*b*. Water is picked up from pick-up tube 626, directed through pump 625, past the venturis 621*a* and 621*b* wherein the water mixes with the concentrate to form the use solution which is directed to the wand 408 through tubes 430*a* and 430*b*. The wet section 624 is separated from the dry section 603 using a separator or partition 623.

The typical environments include kitchens, bathrooms, and other locations requiring cleaning. Often these surfaces are metallic, ceramic, glasis, plastic and other relatively non-porous hard surfaces that can obtain soils from typical human activities within the environment. The liquid concentrates used by the device of the invention are typically formulated to remove soils common in this environment. Soils can include components from hardness components of service water, food soils, human waste, soap scum and film, common grease, dirt and grime, and other conventional common soils. Examples of the types of concentrated cleaning solutions which may be utilized in the dispensing system of the invention include multipurpose cleaners, for example, for walls, windows, tiles and hard surfaces, germicidal detergents for disinfecting and sanitizing floor care products, specialty products for special cleaning needs and others. However, typically these products are formulated with conventional surfactants; but may also contain a rinse aid material that, when present in the cleaner, when rinsed, promotes sheeting and complete removal of the rinse composition without sporting or streaking.

The blend ratio or proportions of liquid concentrate to service water is set by the dimensions of the tubes, the venturi and optional metering tips, if used, prior to the venturi pick-up. Metering tips when used, are held within the pick-up tube at some portion between the pick-up and the venturi. Each metering tip or tube installation is sized and configured to correspond to a particular proportioning ratio. The metering tip's internal diameter may be small to promote dilution ratios of 100:1 to 1000:1 or large to permit a dilution ratio of about 5:1 to about 50:1, for example or other intermediate ratios. Highest dilution ratio or flow rate is typically achieved when no metering tip is present in the pick-up tube. The chemical to water ratio for typical janitorial applications typically ranges from about 1:40 to about 1:8 with the ratio dependent on the size of the tubing or metering tip, the viscosity of the chemical concentrate and the operational rate of the pump.

Pumps used in the dilution system of the invention are typically electrically driven gear pumps having a capacity of about 2000 to 4000 milliliters of aqueous diluent per minute ($mL\text{-}min^{-1}$). The final output of the dilution system depends on the length of the tubing, the flow rate of the spray head, the viscosity of the concentrate and the condition of the rechargeable battery and pump motor. The pressures developed in the system are about 10 to 15 psig at the spray head and about 20 to 22 psig at the pump outlet. The pressure drop across a venturi is about 6 to 8 psig.

The liquid cleaning compositions of this invention are typically formed from a major proportion of water, an acid or base component, a surfactant package that can contain a nonionic, anionic, etc. surfactant, a sequestrant, a cosolvent, a hydrotrope, and other optional ingredients such as dyes, perfumes, etc.

Neutral cleaners are typically aqueous solutions of surfactant materials that are blended in an aqueous solution to have a pH near neutral. Acidic or basic cleaners have a source of acidity or source of alkalinity in combination with the other detergent components. An acetic cleaner comprises an acetic component in a cleaner composition. Examples of useful acids include phosphoric acid, sulfamic acid, acetic acid, hydroxy acetic acid, critric acid, benzoic acid, tartaric acid and the like. Mixtures of such ingredients can provide advantages depending on use locus and soil type.

Basic cleaners typically comprise a source of alkalinity. Both organic and inorganic sources of alkalinity can be used. Inorganic sources of alkalinity include sodium hydroxide (caustic), sodium silicates ($Na_2O:SiO_2$ at 1–100:1), sodium carbonate, potassium hydroxides, carbonate and alkaline salts, etc. Organic sources of alkalinity typically comprise ammonia and organic amines such as mono, di, tri ethanolamine, isopropanalamine, primary and secondary alaphatic amines, hydroxy ethylamine, trihydroxy ethylamine, etc.

The cleaners can comprise a variety of ingredients including anionic, nonionic or cationic surfactant materials, other ingredients, etc. One anionic surfactant useful for detersive purposes can also be included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates. $C_8$–$C_{24}$ alkylpolyglycolethersulfates (containing up to 10 moles of ethylene oxide); alkyl glycerol sulfonates, fatty acyl glycerol sulfonates, fatty oleyl glycerols sulfates, alkyl phenol ethylene oxide ether sulfates, paraffin sulfonates, alkyl phosphates, isethionates such as the acyl isethionates, acyl laurates, fatty acid amides of methyl tauride, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates; sulfates of alkylpolysaccharides such as the sulfates of alkylpolyglucocide (the nonionic nonsulfated compounds being described below), branched primary alkyl, sulfates, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil.

Another type of anionic surfactant which can be utilized encompasses alkyl ester sulfonates. Alkyl ester sulfonate surfactants hereof include linear esters of $C_8$–$C_{20}$ carboxylic acids (i.e., fatty acids) which are sulfonated with gaseous $SO_3$ according to "The Journal of the American Oil Chemists Society." 52 (1975), pp. 323–329. Suitable starting materials would include natural fatty substances as derived from tallow, palm oil, etc. Alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations such as tetramethylammonium and dimethyl piperdinium cations and quaternary ammonium cations derived from alkylamines such as ethylamine, diethylamine, triethylamine, and mixtures thereof, and the like). Alkyl alkoxylated sulfate surfactants hereof are water soluble salts or acids of the formula $RO(A)_mSO_3—M^+$ wherein R is an unsubstituted $C_{10}$–$C_{24}$ alkyl or hydroxy alkyl group having a $C_{10}$–$C_{24}$ alkyl component, preferably $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.). ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium cations and quaternary ammonium cations such as tetramethyl-ammonium and dimethyl piperdinium cations and those derived from alkylamines such as ethylamine, diethylamine, triethylamine, mixtures thereof, and the like.

Conventional, nonionic detersive surfactants for purposes of this invention include the polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company. Nonionic surfactants also include the condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 10 moles of ethylene oxide per mole of alcohol. Examples of commercially available nonionic surfactants of this type include Tergitol™ 15.5.9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45.7 (the condensation product of $C_{14}$–$C_{15}$ linear alcohol with 7 moles of ethylene oxide), Neodol™ 45.4 (the condensation product of $C_{14}$–$C_{15}$ linear alcohol with 4 moles of ethylene oxide), marketed by Shell Chemical Company, and Kyro™ EOB (the condensation product of $C_{13}$–$C_{15}$ alcohol with 9 moles ethylene oxide), marketed by The Procter & Gamble Company. The condensation products of ethylene oxide with a hydrophobic base formed by the condensation of propylene oxide with propylene glycol can also be used. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic™ surfactants, marketed by BASF. Cationic detersive surfactants can also be included in detergent compositions of the present invention. Cationic surfactants include the ammonium surfactants such as alkyldimethylammonium halogenides, and those surfactants having the formula: $[R^2(OR^3)_y][R^4(OR^3)_x]_3R^3N^+X^-$; wherein $R^2$ is an alkyl or alkyl benzyl group having from about 8 to about 18 carbon atoms in the alkyl chain, each $R^3$ is selected from the group consisting of $—CH_3CH_2—$, $—CH_2CH(CH_3)—$, $—CHCH(CH_2OH)—$, $—CH_2CH_2CH_2—$, and mixtures thereof; each $R^4$ is selected from the group consisting of $C_1$–$C_4$ alkyl, $C_1$–$C_4$ hydroxylalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not O; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Typical Formulations

DEGREASER

| RAW MATERIAL | WT % | DESCRIPTION |
|---|---|---|
| Water | q.s. | Diluent |
| Sodium Hydroxide | 10–20 | Alkalinity |
| Sodium Metasilicate | 2–4 | Soft Metal Protection |
| Tetra Sodium EDTA 40% | 1–4 | Chelator |
| Alkyl Poly Glycoside 70% | 1–5 | Surfactant |
| Typical use concentration 6–12 oz/gal | | |

GLASS CLEANER

| RAW MATERIAL | WT % | DESCRIPTION |
|---|---|---|
| Deionized Water | q.s. | Diluent |
| Ammonia (40% Active) Aqueous | 2–8 | Ammonia |
| Sodium Lauryl Ether Sulfate 60% | 0.5–1.0 | Anionic Surfactant |
| Ethylene Glycol Butyl Ether | 5–15 | Glycol Ether Solvent |
| Sodium Xylene Sulfonate 40% Liquid | 1–5 | Coupler |
| Typical use concentration 5–10 oz/gal | | |

ALL PURPOSE CLEANER

| RAW MATERIAL | WT % | DESCRIPTION |
|---|---|---|
| Deionized Water | q.s. | Diluent |
| Linear Alkyl Sulfonate | 3–9 | Nonionic Surfactant |
| Sodium Lauryl Ether Sulfate | 2–6 | Anionic Surfactant |
| Tetra Sodium EDTA 40% Liquid | 1–3 | Chelator |
| Potassium Hydroxide | <0.5 pH 7.5–9.5 | pH adjustment |
| Typical use concentration 1–4 oz/gal | | |

HEAVY DUTY CLEANER

| RAW MATERIAL | WT % | DESCRIPTION |
|---|---|---|
| Water | q.s. | Diluent |
| Ethoxylated Nonyl phenols (9.5 mole to 11 mole) | 5–10 | Nonionic Surfactant |
| Tetra Sodium EDTA 40% Liquid | 5–10 | Chelator |
| Sodium Xylene Sulfonic 40% | 5–10 | Coupler |
| Sodium Metasilicate | 1–4 pH | Alkalinity Source |

-continued

HEAVY DUTY CLEANER

| RAW MATERIAL | WT % | DESCRIPTION |
|---|---|---|
| | 10.5–12.0 | |
| Typical use concentration 1–4 oz/gal | | |

DISINFECTANT

| RAW MATERIAL | WT % | DESCRIPTION |
|---|---|---|
| Soft Water | q.s. | Diluent |
| BTC 2125M (50%) | 6.4 | Quaternary Antimicrobial Active |
| Sodium Carbonate | 3.0 | Buffer |
| Nonylphenol Ethoxylate (11 mole) | 2.5 | Nonionic Surfactant |
| Tetra Sodium EDTA (40%) | 2.5 | Chelator |
| Typical use concentration 1–4 oz/gal | | |

ALTERNATE HEAVY DUTY CLEANER - BIODEGRADABLE

| RAW MATERIAL | WT % | DESCRIPTION |
|---|---|---|
| Water | q.s. | Diluent |
| Ethoxylated Alcohol | 5–12 | Nonionic Surfactant |
| Tetra Sodium EDTA | 5–10 | Chelator |
| Sodium Xylene Sulfonic 40% | 3–8 | Coupler |
| Potassium Hydroxide 45% | 0.5–3 | Alkalinity Source |
| | pH 9.5–12.0 | |
| Typical use concentration 1–4 oz/gal | | |

SANITIZER

| RAW MATERIAL | WT % | DESCRIPTION |
|---|---|---|
| Soft Water | q.s. | Diluent |
| Alkyl Dimethyl Ammonium Chloride (50%) | 2.5–10 | Active Antimicrobial Agent |
| Typical use concentration 1–4 oz/gal | | |

ACID CLEANER

| RAW MATERIAL | WT % | DESCRIPTION |
|---|---|---|
| Soft Water | q.s. | Diluent |
| Sulfamic Acid | 3.5 | Acid |
| Hydroxyacetic | 7.0 | Acid |
| Diethylene Glycol Monobutyl Ether | 4.0 | Solvent |
| Nonyl Phenol (9.5 mole) EO | 1.0 | Nonionic |

The typical viscosities of these materials is about 0 to 1000 cP, preferably about 10 to 250 cP at 25° C.

The apparatus of the invention for diluting a liquid concentrate to a dilute liquid use solution contains an aspirator. Aspirators contain a venturi device driven by water pressure to draw a concentrate. The venturi device comprises a nozzle opening associated with a body of concentrate solution. The velocity of the diluent through the nozzle causes a reduction in pressure, draws the concentrate into the aspirator, generally causing a mixing of the concentrate and diluent typically at a fixed ratio depending on pressure, tubing sizes and length. Once diluted and mixed, the dilute use solution leaves the aspirator through an outlet for the dilute use solution. The outlet is in liquid communication with the use solution container.

The concentrate materials of the invention include general purpose cleaning and sanitizing materials, coating compositions and other useful institutional or industrial liquid concentrates. Such materials include window cleaners, hand soap, hard surface cleaners, floor cleaners, bathroom cleaners, tile cleaners, drain cleaners and drain openers, glass cleaners, cleaners for food preparation units, sanitizers, disinfectants, animal and personal care products, aqueous coating compositions, water reducible concentrates, water reducible floor finishes, aqueous wax dispersions, air fresheners, odor counteractants, and other similar concentrates that can be formed as an aqueous solution, an aqueous alcoholic solution, an aqueous dispersion, an aqueous reducible solution or dispersion, etc.

The liquid concentrate materials useful for dilution to a dilute use solution typically comprise aqueous solutions, aqueous suspensions, aqueous reducible concentrates, aqueous alcoholic concentrates, etc., of cleaning or sanitizing chemicals. The concentrate can contain about 20 to 90 wt % of active cleaning materials. The typical viscosity of the liquid concentrates typically ranges from about 1 to 500 cP. The chemical systems can comprise a surfactant based cleaner, an antimicrobial, a floor finish, etc. The cleaner can be a generally neutral system, an acid-based system containing compatible surfactant, cosolvents and other additives or alkaline systems containing a source of alkalinity, compatible surfactants, cosolvents, etc.

The apparatus is typically adapted and configured to dilute a variety of liquid concentrates to useful dilute use solutions. The cross contamination should be avoided. Acid cleaners can render basic cleaners inoperative. Further, the addition of a chlorine source to an acid can release inappropriate toxic fumes. A variety of other inappropriate interactions can occur resulting ultimately in a use solution that is not appropriate for its intended purpose.

FIGS. 14–25 show another embodiment of a portable delivery/dilution apparatus. FIGS. 7–13 show a primary dilution apparatus that is used with a portable delivery/dilution apparatus to provide for a two-step dilution/deliver) system.

Referring to FIGS. 7–13, wherein like numerals represent like parts throughout the several views, there is generally disclosed at 200 an apparatus for diluting a liquid concentrate with a liquid diluent to form a dilute use solution for dispensing into a bottle 201. The dispensing apparatus 200 includes a base 202 which is mounted on a wall or other mounting surface by means well known in the art. A housing (not shown) may also be used to cover the dispensing apparatus 200. Any suitable housing or covering may be utilized such as that shown in U.S. Pat. No. 5,832,972. However, it is appreciated that the geometric lockout in the cover as shown in U.S. Pat. No. 3,832,972 is not necessary for the present invention as will be evident as different lockout provisions are utilized. The base 202 is preferably formed as a single unit and is a molded plastic part. However, the components may be made separately and later assembled. The base 202 has a back wall 203 and upper sides 204 and 205. Lower sides 206 and 207 are formed as continuations of upper sides 204 and 205 respectively. There is a space between the lower sides 206 and 207 which is sized to accommodate the bottle 201 as will be described more fully hereafter. A bottom member 208 has a bottom section 208*a* and first sides 208*b* and 208*c*. The sides 208*b* and 208*c* have flanges 208*d* and 208*e* respectively which are used to secure the sides 208*b* and 208*c* to the lower side 206 and 207 respectively. Any suitable means such as screws (not shown) may be utilized to secure the bottom member to the base 202. Optionally, bottom member 208 may be molded as an integral part of sides 206 and 207. Screw openings are shown in FIG. 9. The first side 208*b* has an inner radius 208*f* which is of a different geometric shape and is more rounded than the radius 208*g* of the second side 208*c*. As will be described more fully hereafter, the different radiuses form a secondary lockout to prevent the wrong bottle 201 from being inserted into the dispensing apparatus 200.

The bottom section 208*a* has a depressed area 208*h* which forms a drain and a drain tube 209 is in fluid communication with the depressed area 208*h* to drain any spilled liquid. A suitable tube (not shown) is connected to the drain tube 209 to dispose of any spilled liquid.

A controller or valve 210 is mounted to the base by suitable means, such as screws (not shown). The valve 210 has a right sidewall 211 and a left sidewall 212. The sidewalls 211 and 212 have flanges which may accept the screws to secure the valve to the base 202. The valve 210 has a valve body 213 which has an inlet 214 through which a suitable diluent source, such as water, is provided. A pipe plug 215 is located on the opposite side of the valve body as the inlet 214. The inlet 214 is sized and configured to accept a connector which in turn connects to a diluent inlet hose. Mounted to the valve body 213 is an activation switch 216. The activation switch 216 includes a body 216*a* and a depressible push button 216*b*. The button 216*b* is mounted in the body 216*a* with a spring which biases the button away from the valve body to an off position. The valve body 210 has a threaded outlet 217. The valve 50 may be any suitable valve such as Model No. 633B valve assembly made by Dema Engineering of St. Louis, Mo.

The threaded outlet 217 is connected via a pipe 218 to a back flow prevention unit 219. The back flow prevention unit 219 has an exit 220 which is connected to an inlet 221*a* of an elbow 221. The elbow 221 has an exit 221*b* which is connected via a hose (not shown) to an aspirator 222. The aspirator 222 may be any suitable model such as the No. 440220 made by Hydro Systems of Cincinnati, Ohio. The aspirator 222 has an inlet 223. The inlet 223 is connected to an elbow 224 which has an inlet 224*a*. It is the inlet 224*a* which is connected via the hose to the outlet 221*b*. The aspirator 222 includes a venturi. An inlet to the venturi is provided through opening 225. Opening 225 is adapted and configured to accept metering tip which is in turn connected to a tube which is in turn in fluid communication with the liquid to be dispensed. The metering tip is readily changeable to change the concentration of the use solution which comes out of the aspirator 222. The aspirator 222 has an outlet 226 which is in fluid communication with a dispensing nozzle 227. The nozzle has two flanges through which screws 228 are inserted to connect the nozzle 227 to the base 202. The nozzle has a tapered tip 229. The nozzle has a longitudinal bore throughout so as to dispense the use solution.

An activation mechanism, similar to that shown in U.S. Pat. No. 5,832,972 is utilized. The liquid dispenser 200 includes a bracket 230 which is secured to the valve body 213 through two screws (not shown) through openings 231. The bracket 230 has a first side member 232 connected to a second side member 233 by an intermediate member 234. The first side member 232 has a rectangular slot 232*a* and the second side member 233 has a rectangular slot 233*a*. The intermediate member 234 has an aperture 234*a* through which the switch body 216*a* is inserted. Also provided are access holes 234*b*. The access holes 234*b* allow access in order to tighten the screws which connect the controller 210 to the base 202. The rectangular slot 232*a* is placed closer to the intermediate member 234 than the rectangular slot 233*a*.

A slide actuator 235 has a first portion 235*a* connecting a second portion 235*b* by an angled (or inclined) intermediate portion 235*c*. At the first portion 235*a*, is a downwardly depending member 235*d*. This member 235*d* has a slot 235*e* through which the dispensing nozzle 227 may pass as the slide actuator is moved upward. The first portion 235*a* is inserted through the rectangular slot 232*a* and the second portion 235*b* is inserted into the slot 233*a*. The bracket 230 is typically made of plastic and is therefore deformable to allow the second portion 235 to be inserted into the rectangular slot 233*a*. A bottle 201 is typically 16 ounces and preferably between 8 and 32 ounces. The bottle may be any suitable model such as a blow-molded plastic. The bottle 201 has a right side 236, left side 237, back 238, front 239, bottom 240 and top 241 all operatively connected to form a bottle having an inner cavity for receiving a dilute use solution. The top 241 has a neck portion 241*a* which has an opening 241*b*. An insert 242 is positioned inside of the opening 241*b*. The bottle 201, shown in FIG. 1, does not have the insert shown. However, the insert, as shown in FIGS. 11 through 13, is inserted into the opening 241*a* and secured by suitable means either a force fit, or if non-removability is preferred, it is secured by a suitable method such as spin welding, heat welding or epoxy. The insert 242 has a central portion 242*b* with a bore 242*a* extending therethrough. A central portion 242*b* forms a cylindrical portion in which the nozzle 227 is inserted. An outer cylindrical portion 242*c* is connected to the inner cylindrical portion 242*b* by a ring 242*d*. One or more vent holes 242*e* are formed in the ring portion 242*d*. Therefore, air is able to vent between the interior of the bottle 201 and the atmosphere. A dip tube 244 is connected to the cylindrical portion 242*b*. As can be seen in FIG. 13, the cylindrical portion 242*b* has an upper section that has a diameter which is greater than a lower section. However, the bore 242*a* extends throughout the portion 242*b*. In FIG. 13, the dip tube 244 is shown broken away, but preferably the dip tube 244 extends down to the bottom of the bottle 201.

The bottle 201 has a first elongate lockout 245 on the right side 236 and a similar lockout 246 formed in the left side 237. The lockouts 245 and 246 are elongate indentations and are preferably at the same height from the bottom 240. The lockouts 245 and 246 are generally parallel to each other and extend the length of the side. A vertical elongate lockout 247 is formed in the first side 236 and a second vertical lockout 248 is formed in the other side 237. The lockouts 247, 248 are generally elongate and are indentations formed in the sides, similar to the lockouts 245 and 246. The four lockouts generally have a ¼ radius in defining the size of the indentation. A first inwardly extending protruding lockout member 249 is secured to the lower side 206 and a similarly sized protruding lockout 250 is secured to the interior of the lower side 207. The protruding lockouts 249 and 250 are sized to be accommodated inside of the elongate lockouts 245 through 248. The lockouts 249 and 250 are in the shape, of hemispheres. The lockouts are at a height from the bottom 208 such that when the bottom 240 of the bottle sits on the bottom section 208, the protruding lockouts 249 and 250 mate with the elongate lockouts 245 and 246. While the protrusions are hemispheres and the indentations have corresponding geometric shapes, it is understood that other geometric configurations may be used. However, the hemispheres provide for an easy transition when changing from the horizontal to the vertical direction as will be discussed more fully hereafter. While it is preferable to have two vertical lockouts and two horizontal lockouts, it is understood that one of each would also be operable.

There is also provided another lockout feature which matches the shape and configuration of the bottom section 208 to the shape and configuration of the bottom 240 and sides 236 and 237 of the bottle 201. In viewing FIG. 9, it can be seen that the radius 208*g* is sharper and closer to a 90° angle and the radius 208*f* is more rounded. The radius formed between the right side 236 and bottom 240, identified as 251 has a radius which matches that of 208*f*. The radius between the left side 237 and bottom 240, identified as 252, matches that of the radius 208*g*.

It can therefore be seen that the liquid dispenser 200 is designed to accept only a specific bottle 201, thereby insuring that the liquid concentrate being dispensed from dispenser 200 is always dispensed into the correct bottle 201. A second liquid concentrate is dispensed from a dispenser similar to dispenser 200. However, the bottle utilized in the second dispenser would have lockouts 245 and 246 at a different height as would be the corresponding protruding lockouts 249 and 250. The bottoms of the bottle of the second embodiment would be mirror images of the bottle 201. The bottom member of the second embodiment of the liquid dispenser would be a mirror image of bottom member 208. Therefore, the protruding lockouts would prevent the wrong bottle from being inserted as well as would the configuration of the bottom member 208 prevent the wrong bottles from being inserted into the dispenser 200. Therefore, there would be two lockouts to make certain that the right bottle is always filled with the correct liquid concentrate from the appropriate dispenser.

In use, the bottle 201, having elongate lockouts 245 and 246 would be slid into the liquid dispensing apparatus 200. The protruding lockouts 249 and 250 would make certain that the correct bottle 201 is being inserted. Further, the size and configuration of the bottom member 208 also locks out a bottle that does not have the correct bottom shape and configuration. The bottle 201 is slid into the apparatus 200 along the elongate lockouts 245 and 246. Once the bottle 201 is fully inserted, the user then lifts up on the bottle and the protruding members 249 and 250 then guide the bottle as it is moved upwards and the protruding members 249 and 250 are positioned inside of the vertical elongate lockouts 247 and 248. The vertical alignment allows for the proper alignment of the bore 242*a* with the nozzle tip 229.

As the bottle 201 is being raised, it encounters the member 235*d*. When the slide actuator is in a first position (non-use) the switch 216*b* is fully extended and is under the second portion 235*b*. Then, as the slide actuator is moved to the second position (use), the inclined portion 235*c* contacts the button 216*b* and depresses it downward as the slide bracket travels in a direction substantially parallel to the longitudinal access. The motion of the switch 216*b* is in a direction substantially perpendicular to that of the movement of the bottle 201. It is important that the nozzle 229 be inside of the bottle when filling occurs. Therefore, it is important to coordinate the amount of travel of the incline section 235*c* necessary to activate the switch 216*b*. In the embodiment shown, the tip 229 is approximately 3/16" above the member 235*d*. Then, after an upward travel of approximately ½", the nozzle is inside of the bottle and finally ⅛" of additional travel activates the switch 216*b* at which time the nozzle tip is further into the bottle. Upon the depressible switch 216*b* being activated, the activation switch 216 allows the valve 210 to allow the diluent to enter the inlet 214. Water then exits through the outlet and out the tapered tip 229. As it exits, the diluent flows through the valve body, then draws liquid concentrate which is dispensed through the aspirator into the diluent to form a use solution which exits the nozzle into the bottle 201.

Referring now to FIG. 14, there is shown another embodiment of a portable delivery/dilution apparatus of the present invention, designated generally at 300. The apparatus 300 includes a reservoir 301. Preferably, the reservoir is made of plastic and has an inner cavity 301*a* for receiving a diluent, typically water. The reservoir 301 is preferably formed as a single plastic reservoir, but it is understood that other suitable methods of construction may be utilized. The reservoir 301 has a right side 302, left side 303, front 304 and rear 305 which define the inner cavity 301*a*. At the bottom of the reservoir 301 is a T-shaped extension 306 which is utilized to support other components of the apparatus 300, as will be described more fully hereafter. The interior of the T-shaped extension 306 still forms a portion of the inner cavity 301*a*, thereby more effectively providing a larger reservoir in a compact space. The reservoir has an opening 307 at its top to receive the diluent, typically from a faucet in a bathtub. As can be seen in FIG. 17, the front 304 has an angled top portion 304*a* and a more vertical portion 304*b*. The reservoir 301 is therefore formed with a funnel shaped top to receive the water. This allows for the apparatus 300 to be placed up next to the edge of the bathtub faucet and more easily receive the water into the inner cavity 301*a*. The vertical portion 34*b* is set back from the angled portion 304*a* so that any hardware on a vertical wall of the bathtub does not interfere with the loading of the water into the reservoir 301. As can be seen in FIG. 20, the bottom of the vertical portion 304*b* has an indentation 308 formed in the general shape of ¼ of a sphere. This provides clearance for bathtubs that have drains which extend upward. Further, the reservoir 301 has two feet 309 to support the reservoir 301.

A housing 310 is preferably formed as a single plastic component, although it is recognized that other suitable construction may be utilized. The housing 310 has a front wall 311 and a generally rectangular wall structure to define an inner cavity 312. The inner cavity 312 is defined by right sidewall 313, left sidewall 314, bottom 315, back 329 and a generally rounded top 316. The front wall 311 does not extend below the top 316. An L-shaped handle 317 is secured at one end to the top 316 by suitable means such as screws (not shown). At its other end, the handle 317 has a rectangular plate 317*a* which is secured to the front wall 311. The screws extend through the front wall 311 and into the rear 305 to secure the housing 310 to the reservoir 301. The top 316 has a slot 316*a* through which hoses extend and a rectangular opening 316*b* through which a rectangular shaped rechargeable battery 318 is inserted.

A pump 319 is secured to the reservoir 301 by screws 320. The pump 319 has a rectangular housing section 321 for receiving the rechargeable battery 318. The pump 319 has a pump head 319*a* which has an inlet 319*b* connected via a hose 322 to the reservoir 301. The outlet of the pump 319*c* is connected to a hose 323. Connected to the hose 323 is a Y-fitting 324. A first hose 325 is connected to one of the branches and a second hose 326 is connected to the other branch of the Y-fitting 324. A first aspirator 327 and second aspirator 328 are mounted on the pump 319. The aspirators have inlets 327*a* and 328*a* as well as outlets 327*b* and 328*b*. Further, first aspirator 327 has a venturi inlet 327*c* and the second aspirator has a venturi inlet 328*c*.

In the preferred embodiment, the pump 319 is a B&D UGP2000 gear pump with a maximum capacity of 0.6 gallons per minute. The rechargeable battery 318 is a Panosonic LCSD 122P sealed lead acid battery with a 2.0 amp capacity. The aspirators 327 and 328 are Dema Model 200C aspirators. The reservoir 301 has a capacity of 0.8 gallons and the weight of the apparatus 300 is 8.5 pounds. While these are the preferred embodiment characteristics, it is understood the ranges applicable to the embodiments shown in FIGS. 1–6 are also applicable to the embodiment shown in FIGS. 14–25.

The back of the housing 329 has two openings 330 and 331 into which bottles 201 and 901. The bottle 901 is identical to the bottle 201 with the exception that the elongate lockouts 945 and 946 are at an elevation higher than the corresponding lockouts 245 and 246 on bottle 201. The only additional difference is that the vertical lockout 947 necessarily extends higher in order to intercept the lockout 945. A lockout assembly 902 has a first lockout section 902*a* and a second lockout section 902*b* connected by a back plate 902*c*. The lockout assembly 902 is suitably connected to the housing 310 by suitable means. As shown, the lockout section 902*a* is secured by adhesive to the right sidewall 313 and this supports the entire lockout assembly 902. Each lockout section 902*a* and 902*b* has a flat surface and a hemisphere surface to provide matching geometric shapes with the lockout sections 245 and 246. Another lockout assembly 903 is a mirror image of lockout assembly 902 and is secured to the left sidewall 314. However, the lockout assembly 903 is secured at a height higher than that of lockout member 902 so that the lockout assembly 903 mates with the horizontal lockouts 945 and 946 of the bottle 901. Each lockout assembly 902 and 903 has a shorter section 902*b* and 903*b* so as not to interfere with the spring clip 904. The spring clip 904 is secured by screws 905 to the T-shaped section of the reservoir 301. The spring clip 904 has a right arm 904*a* and a left arm 904*b*. Both arms deflect inward and form a generally V-shape. The V of each arm 904*a* and 904*b* is sized and configured to form a snap fit inside of the vertical lockouts 947 and 247.

Two fitments 906 are slidably mounted in the housing 310 and provide for the method of removing concentrate from the bottles 201 and 901. The fitments 906 have a knob 906*a* attached at one end to allow for moving the fitment 906 up and down. The fitment is shown in more detail in FIGS. 21 through 23 (without the knob 906*a* attached). The fitment has a cylindrical shaft 907 that slides inside of a bore formed in the housing 310. The shaft 907 has an enlarged circular head 907*a* that defines an inner cavity 907*b*. The inner cavity 907*b* has an exit port 907*c*. A connector 908 is secured to the exit port 907*c* and provides for a connection with a delivery hose 909. A sealing head 910 has a central bore 910*a* that has an opening 910*b*. The bore 910*a* is sized to fit around the circular head 907*a* and is secured by suitable means such its an adhesive or heat welding. The bore 910*a* allows for fluid communication between the bore 910*a* and the inner cavity 907*b*. The sealing head 910 has a first circular member 911 which is sized and configured to fit inside of the cylindrical portion 242*c* of the bottle 201. An O-ring 912 fits inside of the groove 911*a*. The O-ring 912 is shown only in cross section in FIG. 23, it being understood that it should also appear in FIGS. 21 and 22. The O-ring 912 provides for a seal to seal the fitment 906 inside of the bottle 201. The sealing head 910 has a circular sealing end 913, the circular sealing end is sized and configured to fit inside of the cylindrical portion 242*b* of the bottle 201. A circular indentation 911*b* provides for clearance for the top portion of the cylindrical portion 242*b* to slide into the circular indentation to allow for the sealing end 913 to seat at the bottom of the circular portion 242*d*. A vent hole 911*c* is drilled in the circular indentation 911*b* through the circular member 911 to allow for venting of the bottle 201 as liquid concentrate is being pulled out, as will be described more fully hereafter.

Another fitment 906 is positioned over the opening 331 to allow for withdrawal of product through bottle 901. A delivery hose 914 connects the fitment 906 to the second aspirator 328.

A hanging hook 350 is shown in FIGS. 14 and 15 attached to the handle 317. The wire hook 350 has two circular members 351 which are positioned around the handle 317 and are sized to allow rotation around the handle 317. A bar engaging hook 352 is connected to each circular member 351. The hooks 351 allow the entire apparatus 300 to be hung from a bar on a cart typically used by hotel maids.

A wand 915 has a spray nozzle 916. The wand 915 includes a valve 917 to which hoses 918 and 919 are connected. The hose 918 has one end in fluid communication with the outlet 327*b* of the first aspirator 327 and its other end connected to the valve 917. Hose 919 has a first end in fluid communication with the outlet 328*b* of the second aspirator 328 and its other end connected to the valve 917. The valve 917 is a three-way valve and allows for selection between the two aspirators 327 and 328. The wand 915 has a trigger switch 915*a* which, as will be described more fully hereafter, activates the pump 319.

FIG. 24 is a schematic of the wiring for the apparatus 300. The rechargeable battery 318 provides power for the pump 319. A relay 920 is utilized to control the operation of the pump 319. In order for the pump 319 to be activated, the trigger switch 915*b* must be depressed as well as float switch 921. The float switch is positioned inside of the reservoir 301 towards the bottom of the reservoir. The float switch 921 prevents the running of the pump 319 when there is insufficient water in the reservoir 301. FIG. 25 is a flow diagram of the present invention and should be referred to in reading the following description of the operation of the invention. The slot 316*a* provides an opening in the housing through which the hoses 918, 919 extend as well as wiring from the wand trigger to the pump.

The liquid dispenser apparatus 200 is utilized to fill the bottle 201 with a first concentrate at a first dilution ratio of a use solution. A similar liquid dispensing apparatus is utilized to fill the bottle 901 with a second concentrate of a second concentrate to form a second use solution. As previously mentioned, the other liquid dispensing apparatus has the protruding lockouts 250 at another height so that only the correct bottle is filled with the correct solution as a different type of concentrate would be dispensed into the bottle 901. Also, as previously discussed, the metering tip that is used in association with the liquid dispensing apparatus 200 is easily replaced and the dilution of the first and second use solutions may be adjusted. The bottles 201 and 901 are then inserted into the portable delivery/dilution apparatus 300. As viewed in FIG. 15, the bottle 201 is inserted into the right portion and the bottle 901 is inserted into the left portion in order to insert the bottles, the fitment 906 is raised and the bottles are slid into the openings 330 and 331. The lockout assemblies 902 and 903 assure that only the correct bottle is inserted into the openings. Once inserted, the fitment 906 is lowered. In doing so, the vent hole 242*e* is sealed from being operational by the O-ring 912. The sealing end 913 is inserted into the bottle 201 and makes contact with the bottom of the circular portion 242*b*. The dip tube 244 was utilized in filling the bottle 201 by allowing the use solution to be placed into the bottle 201 from the bottom up. This prevents excess foaming. However, the same dip tube 244 is also utilized to dispense the product, as will be described more fully hereafter.

After the bottle 901 is similarly inserted into the opening 331, the portable delivery/dilution apparatus is ready to be used by a user. As previously mentioned, a hotel or similar establishment may have fifteen to thirty or more portable delivery/dilution apparatus 300 at one location. The reservoir 301 is first filled with a diluent, such as water, from the faucet of a bathtub. The unit is then ready to be utilized. The first use solution in the bottle 201 may be dispensed by activation of the trigger switch 915*a*. This causes the pump to activate and diluent is taken from the reservoir 301 via hose 322 to the pump 319. The diluent is supplied to both aspirators 327 and 328. Depending upon which way the valve 917 is operated by the switch 915*b*, the use solution from either the bottle 201 or 901 will be allowed to flow through their respective aspirators and out the spray nozzle 916. The use solution that is coming out of the spray nozzle 916 is at a second dilution which is less than the dilution in the bottles 201 or 901. This allows for one bottle to supply the necessary concentrate for a typical day's work by a maid in a hotel. The use solution is drawn up through the bottles 201 or 901 through its dip tube 244 and out the hose 909 or 914. The vent hole 911*c* allows for a vacuum to be released as product is withdrawn from the bottles 201 or 901. If, due to changing water conditions, cleanliness standards or other factors, it is desired to use a different end use concentration, it is not necessary that each of the portable delivery/dilution apparatus 300 be adjusted. It is only necessary that the dispensing apparatus 200 be adjusted. The dilution ratios of the liquid dispensing apparatus 200 and the portable delivery/dilution apparatus 300 are dependent on the use concentrations of the end use solution. The portable delivery/dilution apparatus 300 are not readily adjustable. However, they do have some ability to be changed by the manufacturer or a technician. Generally, the dispenser apparatus 200 may have dilution ratios of from 5 to 40 ounces per gallon.

It is understood the present invention could also be used for dispensing more than two liquids through more than two bottles.

A thermo-chromatic temperature sensor may be incorporated into the reservoir 301 to inform the user if a correct temperature of diluent has been added to the reservoir 301. Such thermo-chromatic sensors are disclosed in U.S. Pat. Nos. 5,385,044 and 5,707,590. The sensor is formed as an integral part of the reservoir and is therefore not seen in the drawings. Alternatively, the sensor could be an added-on sticker. The sensor will change color at a preset temperature. For example, some chemicals work better at 95° F., so a sensor that changes at 95° F. is used. Other chemicals work better at different temperatures and a different or additional sensors may be used for other temperatures.

The above specification, drawings, chemical formulation information and test data provide a basis for understanding the invention. However, since many embodiments of the invention may be implemented without departing from the spirit and scope of the invention, the invention resides in the claims hereinafter appended.

We claim:

1. A method of providing a final concentration of product dispensed by a secondary delivery/dilution apparatus, the method comprising:

a) providing a liquid concentrate to be diluted by a liquid diluent;

b) dispensing the liquid concentrate at a first dilute solution into a bottle;

c) inserting the bottle into a secondary delivery/dilution apparatus, the apparatus having a reservoir for holding a liquid diluent;

d) diluting the first dilute solution to a second dilute solution; and e) dispensing the second dilute solution for use by a user.

2. The method of claim 1, wherein the final concentration of product is dispensed by multiple secondary delivery/dilution apparatus and steps 1(b) through 1(e) are repeated for each delivery/dilution apparatus.

3. The method of claim 2, wherein the delivery/dilution apparatus are portable.

4. The method of claim 1, further comprising dispensing the first dilute solution from a dispenser that is readily adjustable and dispensing the second dilute solution from an apparatus that is not readily adjustable, wherein varying final concentrations in the second dilute solution is obtainable by changing the dispenser of the first dilute solution, thereby eliminating a need to adjust the multiple secondary delivery/dilution apparatus.

5. A system for dispensing a final concentration of product dispensed by multiple delivery units, comprising:

a) a first dispenser, comprising:

i) an aspirator having a liquid diluent inlet, an inlet for liquid concentrate and an outlet for a first dilute solution, the aspirator being readily modified for varying the concentration of the first dilute solution;

ii) a valve operably connected to the aspirator for controlling flow of liquid diluent from a source of liquid diluent to the aspirator inlet; and iii) a first bottle to receive the first dilute solution from the aspirator outlet;

b) multiple portable self-contained delivery/dilution units, each unit comprising:

i) the first bottle of the first dilute solution;

ii) a fillable and emptiable reservoir containing liquid diluent;

iii) an aspirator, having a setting for delivering out its outlet a second dilute solution;

iv) pump to control flow into and out of the aspirator;

v) a spray member in fluid communication with the outlet of the aspirator, wherein the second dilute solution is dispensed by a user; and c) the multiple units each are useable by a respective user and wherein a concentration of the second dilute solution in each portable unit is controllable by a concentration of the first dilute solution which is readily modified, thereby allowing different concentrates to be used by the portable units without modifying the multiple portable units.

6. The system of claim 5, wherein the aspirator has a fixed setting.

7. The system of claim 5, wherein the battery is rechargeable.

8. The system of claim 5, further comprising a metering device operatively connected to the inlet of the aspirator of the first dispenser, wherein the metering device is readily replaceable.

9. A portable self-contained dispensing system, that can contact surfaces with a first liquid spray followed by a second spray, the system comprising:

a) a fillable and emptiable container, for a volume of an aqueous diluent of less than 10 liters;

b) a dilution section, having a dry portion and a wet portion;

i) the wet portion comprising a venturi and a wet portion of a pump, wherein a pump intake is in liquid communication between the container and a pump inlet, a pump outlet is in liquid communication between the pump and the venturi, the venturi comprising a concentrate inlet and the venturi in liquid communication with an outlet; and ii) the dry portion of the station comprising a battery, a dry portion of the pump and sufficient wiring to power the pump;

c) a source of concentrate in liquid communication with the concentrate inlet of the venturi; and d) spray means in separate liquid communication with the venturi outlet and another outlet, comprising a valve that can select either a first liquid spray or a second liquid spray;

wherein the pump has a pumping capacity of up to about 2000 to 3000 mL/min and the system, with the container filled with an effective amount of diluent, weighs less than 7 kg.

10. The dispensing system of claim 9 wherein the reservoir is in liquid communication with the spray means to provide for a rinse with the aqueous diluent, the aqueous diluent providing the second liquid spray.

11. The dispenser system of claim 9, further comprising a second source of liquid concentrate in liquid communication with a second concentrate inlet of a second venturi; the second source of concentrate providing for the second liquid spray.

12. A portable self-contained dispensing system, comprising:

a) a fillable and emptiable container for holding an aqueous diluent;

b) a dilution section operatively connected to the container, the dilution section comprising:

i) a pump having an inlet in fluid communication with the container and an outlet in fluid communication with first and second aspirators, each aspirator having an inlet and an outlet;

ii) a power source operatively connected to the pump;

iii) a first source of concentrate in fluid communication with the inlet of the first aspirator;

iv) a second source of concentrate in fluid communication with the inlet of the second aspirator;

c) a spray member in fluid communication with the first and second aspirator outlets;

d) a first bottle for holding the first concentrate and a second bottle for holding the second concentrate; and e) a valve to control fluid flow from the first and second aspirators, wherein the pump pressurizes flow from both aspirators and the valve blocks flow through one of the aspirators as the other of the aspirators operates.

13. The system of claim 12, further comprising a dip tube positioned in the bottle, the dip tube in position when the bottle is filled and also used to dispense liquid from the bottle.

14. The system of claim 12, further comprising a float switch positioned in the reservoir, wherein the pump is shut off when the level of diluent in the reservoir is low.

15. The system of claim 12, farther comprising a handle to carry the system and a wire hook having a first end attached to the handle and a second end adapted to be hung on an elongate member.

16. The system of claim 12, further comprising a lockout member allowing general horizontal movement of at least one of the bottles into the system.

17. The system of claim 16, further comprising a secondary lockout mechanism, the secondary lockout mechanism having a shape matching a shape of at least one of the bottle's lower portion to allow access to only bottles with a correct shape.

18. The system of claim 12, further comprising a fitment for insertion into the bottle for removing liquid from the bottle, the fitment comprising:

a) a sealing head for positioning next to an opening in the bottle;

b) a sealing head to seal off vent holes in the bottle; and c) a vent hole in the sealing head to allow the bottle to vent during emptying.

* * * * *